US009399352B2

(12) United States Patent
Mizutani et al.

(10) Patent No.: US 9,399,352 B2
(45) Date of Patent: Jul. 26, 2016

(54) LIQUID CONTAINER

(71) Applicant: SEIKO EPSON CORPORATION, Tokyo (JP)

(72) Inventors: Tadahiro Mizutani, Shiojiri (JP); Noriaki Okazawa, Shiojiri (JP); Hiroyuki Kobayashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/801,369

(22) Filed: Jul. 16, 2015

(65) Prior Publication Data

US 2016/0016412 A1 Jan. 21, 2016

(30) Foreign Application Priority Data

Jul. 17, 2014 (JP) ..... 2014-146450

(51) Int. Cl.
*B41J 2/175* (2006.01)
*B65D 75/36* (2006.01)

(52) U.S. Cl.
CPC ..... *B41J 2/17553* (2013.01); *B41J 2/17533* (2013.01); *B65D 75/36* (2013.01)

(58) Field of Classification Search
CPC .... B41J 2/175; B41J 2/17513; B41J 2/17533; B41J 2/17536; B41J 2/17553; B65D 77/003; B65D 77/04; B65D 77/0406; B65D 77/0413; B65D 7/0426; B65D 81/025; B65D 75/36
USPC ..... 347/86, 108; 206/96, 121, 461, 462, 206/463, 466, 720, 721, 722, 723, 724
See application file for complete search history.

(56) References Cited

U.S. PATENT DOCUMENTS 5,701,995 A * 12/1997 Higuma ..... B41J 2/17533 206/205
6,283,587 B1 * 9/2001 Umemura ..... B41J 2/17533 347/86
6,412,933 B2 * 7/2002 Umemura ..... 206/320
6,502,701 B2 * 1/2003 Shinada ..... B65D 81/025 206/461
6,786,583 B2 * 9/2004 Ota ..... B41J 2/17533 347/108
8,172,382 B2 * 5/2012 Kanbe ..... B41J 2/17513 347/19
8,895,850 B2 * 11/2014 Etori ..... B82Y 20/00 136/263

FOREIGN PATENT DOCUMENTS

JP 2003-034362 A 2/2003

* cited by examiner

*Primary Examiner* — Anh T. N. Vo
(74) *Attorney, Agent, or Firm* — Foley & Lardner LLP

(57) ABSTRACT

A technique that can restrict an arrangement angle of a liquid cartridge before use in a packaged state is provided. A packaging body 10 of a cartridge 100 includes a bag-shaped member 20 and a box-shaped member 30. The bag-shaped member 20 houses the cartridge 100. The box-shaped member 30 houses the cartridge 100 housed in the bag-shaped member 20. The cartridge 100 has an atmosphere introduction hole 125*b* capable of introducing the atmosphere to the inside, and the box-shaped member 30 has a first side wall portion 36 located at a position opposed to the atmosphere introduction hole 125*b*. The first side wall portion 36 has a first and second outer wall surfaces 36*a* and 36*b* that intersect each other to constitute a projecting portion that projects outward. A third end side portion 23 of the bag-shaped member 20 is housed at a corner portion between the first and second outer wall surfaces 36*a* and 36*b*.

26 Claims, 25 Drawing Sheets

LIQUID CONTAINER

CROSS-REFERENCE TO RELATED APPLICATIONS

This application claims priority to Japanese Patent Application No. 2014-146450 filed on Jul. 17, 2014. The entire disclosure of Japanese Patent Application No. 2014-146450 is incorporated herein by reference.

BACKGROUND

1. Technical Field

The present invention relates to liquid containers.

2. Related Art

Hitherto, an ink cartridge is used to supply ink to an inkjet printer (hereinafter also referred to simply as a "printer"). An ink cartridge is housed in a packaging member such as a paper box when being commercially distributed, for example (e.g., JP-A-2003-034362).

If unexpected impact is applied to an ink cartridge during distribution, for example, there is a possibility that ink leaks from an opening portion such as an atmosphere introduction hole, depending on the angle of arrangement thereof. In addition, in the case of an ink cartridge containing pigment ink, there is a possibility that an uneven concentration distribution of a color material component occurs in the ink when the ink cartridge is left standing at a certain arrangement angle for a long time. Depending on the condition of the concentration distribution of the color material component, print quality degrades in some cases, e.g., the concentration of a printed image becomes uneven. For this reason, in an ink cartridge for pigment ink, it is desirable to restrict an arrangement thereof at an arrangement angle at which a concentration distribution of a color material component that leads to degradation of print quality occurs.

In JP-A-2003-034362 mentioned above, the ink cartridge is housed in a package at an arrangement posture that is different from the arrangement posture when the ink cartridge is installed in a printer, such that the concentration distribution of a color material component in the ink is resolved when the ink cartridge is installed in the printer. However, with the technique in JP-A-2003-034362, there is a possibility that the arrangement posture of the ink cartridge is not different from the arrangement posture at the time of installation in the printer depending on the arrangement angle of the package itself. Thus, there is still room for improvement in the restriction of the arrangement angle of an ink cartridge before use in a state of being packaged.

SUMMARY

The invention has been made to solve the foregoing problem in not only a liquid container in which an ink cartridge is housed but also a liquid container regarding which it is desirable to restrict at least the arrangement angle thereof. The invention can be achieved in the following modes.

[1] According to a first mode of the invention, a liquid container is provided. The liquid container in this mode may include a liquid cartridge, a housing member, and an exterior member. The liquid cartridge may contain liquid. The housing member may be constituted by a sheet-shaped member and house the liquid cartridge. The exterior member may be a box-shaped member that houses the liquid cartridge housed in the housing member. The liquid cartridge may have an atmosphere introduction hole with which the atmosphere can be introduced to the inside. The exterior member may have at least a wall portion located at a position opposed to the atmosphere introduction hole. The wall portion may have a projecting portion that projects in a direction extending from the atmosphere introduction hole toward the wall portion. The housing member may have an end portion located between the wall portion and the liquid cartridge. With the liquid container in this mode, an arrangement of the liquid cartridge at an arrangement angle at which the atmosphere introduction hole is oriented vertically downward is restricted by the projecting portion of the exterior member. Furthermore, a change of the arrangement position and the arrangement angle of the liquid cartridge within the exterior member is suppressed by the end portion of the housing member.

[2] In the liquid container in the above mode, the end portion of the housing member may be housed in a space formed within the projecting portion. With the liquid container in this mode, since the end portion of the housing member is housed in the inside space of the projecting portion, a change of the arrangement position and the arrangement angle of the liquid cartridge within the exterior member is further suppressed. Furthermore, the efficiency of usage of the space within the exterior member is enhanced, and the size and the weight of the liquid container can be reduced.

[3] In the liquid container in the above mode, the projecting portion may be formed by projecting a surface of the wall portion, and have two or more flat surfaces inclining with respect to a direction extending from the atmosphere introduction hole toward the wall portion. When at least one of the flat surfaces of the projecting portion is oriented vertically downward, the center of gravity of the exterior member may be located at a position that is out of the flat surface as viewed in a direction parallel with a vertical direction. With the liquid container in this mode, since the arrangement posture is unstable when the liquid container is arranged at an arrangement angle at which the atmosphere introduction hole is oriented vertically downward, the arrangement at this arrangement angle is restricted.

[4] In the liquid container in the above mode, the projecting portion may be constituted by a curved surface formed by projecting a surface of the wall portion. With the liquid container in this mode, the arrangement posture is unstable when the liquid container is arranged at an arrangement angle at which the atmosphere introduction hole is oriented vertically downward, and the arrangement at this arrangement angle is restricted.

[5] In the liquid container in the above mode, the housing member may have a bent portion that is bent between the wall portion and the liquid cartridge. With the liquid container in this mode, a change of the arrangement position and the arrangement angle of the liquid cartridge within the exterior member is further suppressed by the bent portion. Furthermore, since the bent portion functions as an impact absorbing portion, the characteristic of protection of the liquid cartridge is enhanced.

[6] In the liquid container in the above mode, the liquid may contain a dispersoid component. The liquid cartridge may house a liquid holding member capable of holding the liquid, and have a liquid supply port with which the liquid can be supplied to the outside. The exterior member may have, in addition to a first wall portion that is the wall portion, a second wall portion located at a position opposed to the liquid supply port when the liquid cartridge is housed, and have, in addition to a first projecting portion that is the projecting portion, a second projecting portion that projects in a direction extending from the liquid supply port toward the second wall portion. The housing member may have, in addition to a first end portion that is the end portion, a second end portion located between the second wall portion and the liquid cartridge. With the liquid container in this mode, an arrangement at an arrangement angle at which the atmosphere introduction hole or the liquid supply port is oriented vertically downward is suppressed by the first projecting portion and the second projecting portion. Accordingly, leakage of liquid from the atmosphere introduction hole or the liquid supply port and an uneven distribution of a dispersoid component on the side of the liquid supply port are suppressed.

[7] According to a second mode of the invention, a liquid container is provided. This liquid container may include a liquid cartridge, a housing member, and an exterior member. The liquid cartridge may contain liquid. The housing member may be constituted by a sheet-shaped member and house the liquid cartridge. The exterior member may be a box-shaped member that houses the liquid cartridge housed in the housing member. The liquid cartridge may have an atmosphere introduction hole with which the atmosphere can be introduced to the inside. The exterior member may have at least a wall portion located at a position opposed to the atmosphere introduction hole. An outer wall surface of the wall portion may be constituted by one or more flat surfaces inclining with respect to a direction extending from the atmosphere introduction hole toward the wall portion. The housing member may have an end portion located between the wall portion and the liquid cartridge. With the liquid container in this mode, an arrangement of the liquid cartridge at an arrangement angle at which the atmosphere introduction hole is oriented vertically downward is restricted by the inclination of the outer wall surface of the wall portion. Furthermore, a change of the arrangement position of the liquid cartridge within the exterior member is suppressed by the end portion of the housing member.

[8] In the liquid container in the above mode, when at least one of the flat surfaces of the wall portion is oriented vertically downward, the center of gravity of the exterior member may be located at a position that is out of the flat surface as viewed in a direction parallel with a vertical direction. With the liquid container in this mode, since the arrangement posture is unstable when the liquid container is arranged at an arrangement angle at which the atmosphere introduction hole is oriented vertically downward, the arrangement at this arrangement angle is restricted.

[9] In the liquid container in the above mode, the liquid may contain a dispersoid component. The liquid cartridge may house a liquid holding member capable of holding the liquid, and have a liquid supply port with which the liquid can be supplied to the outside. The exterior member may have, in addition to a first wall portion that is the wall portion, a second wall portion located at a position opposed to the liquid supply port of the liquid cartridge that is housed. An outer wall surface of the second wall portion may be constituted by one or more flat surfaces inclining with respect to a direction extending from the liquid supply port toward the wall portion. The housing member may have, in addition to a first end portion that is the end portion, a second end portion located between the second wall portion and the liquid cartridge. With the liquid container in this mode, an arrangement at an arrangement angle at which the atmosphere introduction hole or the liquid supply port is oriented vertically downward is restricted. Accordingly, leakage of liquid from the atmosphere introduction hole or the liquid supply port and an uneven distribution of a dispersoid component on the side of the liquid supply port are suppressed.

[10] In the liquid container in the above mode, the atmosphere introduction hole and the liquid supply port of the liquid cartridge may be formed so as to open in opposite directions. The exterior member may have a third wall portion that intersects the first wall portion and the second wall portion, and a fourth wall portion that intersects the first wall portion and the second wall portion and faces the third wall portion. A space surrounded by the first wall portion, the second wall portion, the third wall portion, and the fourth wall portion of the exterior member may have a polygonal cross-section. With the liquid container in this mode, the arrangement angle of the liquid cartridge can be restricted by a corner portion and a side face that the exterior member has.

[11] In the liquid container in the above mode, the space may have a hexagonal cross-section. With the liquid container in this mode, the arrangement angle of the liquid cartridge can be restricted by making a cross-sectional structure of the exterior member hexagonal.

[12] In the liquid container in the above mode, the space may have a trapezoidal cross-section. With the liquid container in this mode, the arrangement angle of the liquid cartridge can be restricted by making a cross-sectional structure of the exterior member trapezoidal.

[13] According to a third mode of the invention, a liquid container is provided. This liquid container may include a liquid cartridge, a housing member, and an exterior member. The liquid cartridge may contain liquid. The housing member may be constituted by a sheet-shaped member and house the liquid cartridge. The exterior member may be a box-shaped exterior member that houses the liquid cartridge housed in the housing member. The liquid cartridge may have an atmosphere introduction hole with which the atmosphere can be introduced to the inside. The exterior member may have at least a wall portion located at a position opposed to the atmosphere introduction hole, and a protruding portion that extends so as to further projects than an outer wall surface of the wall portion in a direction extending from the atmosphere introduction hole toward the wall portion. The housing member may have an end portion located between the wall portion and the liquid cartridge. With the liquid container in this mode, an arrangement of the liquid cartridge at an arrangement angle at which the atmosphere introduction hole is oriented vertically downward is restricted by the protruding portion of the exterior member. Furthermore, a change of the arrangement position of the liquid cartridge within the exterior member is suppressed by the end portion of the housing member.

[14] In the liquid container in the above mode, the liquid may contain a dispersoid component. The liquid cartridge may house a liquid holding member capable of holding the liquid, and have a liquid supply port that opens in a direction opposite to an opening direction of the atmosphere introduction hole. The exterior member may have, in addition to a first wall portion that is the wall portion, a second wall portion that is located at a position opposed to the liquid supply port and faces the first wall portion, and have, in addition to a first protruding portion that is the protruding portion, a second protruding portion extending in a direction extending from the liquid supply port toward the second wall portion, so as to further project than an outer wall surface of the second wall portion. The housing member may have, in addition to a first end portion that is the end portion, a second end portion located between the second wall portion and the liquid cartridge. With the liquid container in this mode, an arrangement at an arrangement angle at which the atmosphere introduction hole or the liquid supply port is oriented vertically downward is restricted. Accordingly, leakage of liquid from the atmosphere introduction hole or the liquid supply port and an uneven distribution of a dispersoid component on the side of the liquid supply port are suppressed.

[15] In the liquid container in the above mode, the atmosphere introduction hole may be formed at a position close to an end portion of the liquid cartridge. The exterior member may have an atmosphere introduction hole side wall portion that is arranged at a position adjacent to the end portion of the liquid cartridge and intersects the wall portion. The atmosphere introduction hole side wall portion may have a projection portion that projects in a direction extending from the atmosphere introduction hole toward the end portion of the liquid cartridge. With the liquid container in this mode, an arrangement at an arrangement angle with the end portion of the cartridge to which the atmosphere introduction hole is close on the lower side is restricted by the projection portion of the atmosphere introduction hole side wall portion. Accordingly, an arrangement with the atmosphere introduction hole on the lower side in the gravity direction is restricted.

[16] In the liquid container in the above mode, the atmosphere introduction hole may be formed at a position close to an end portion of the liquid cartridge. The exterior member may have an atmosphere introduction hole side wall portion that is arranged at a position adjacent to the end portion of the liquid cartridge and intersects the wall portion. The exterior member may have an extending portion that further extends than an outer wall surface of the atmosphere introduction hole side wall portion in a direction extending from the atmosphere introduction hole toward the end portion of the liquid cartridge. With the liquid container in this mode, an arrangement with the atmosphere introduction hole on the lower side in the gravity direction is suppressed by the extending portion.

[17] In the liquid container in the above mode, the atmosphere introduction hole may be formed at a position close to an end portion of the liquid cartridge. The exterior member may have an atmosphere introduction hole-separate wall portion that is arranged in a direction opposite to a direction extending from the atmosphere introduction hole toward the end portion of the liquid cartridge and intersects the wall portion. The atmosphere introduction hole-separate wall portion may have a flat wall surface parallel with a direction extending from the atmosphere introduction hole toward the wall portion. With the liquid container in this mode, a stable arrangement is achieved by an arrangement angle with the atmosphere introduction hole-separate wall portion as a bottom face. Accordingly, an arrangement of the liquid container with the atmosphere introduction hole located on the vertically lower side is suppressed.

[18] According to a fourth mode of the invention, a liquid container is provided. The liquid container in this mode may include a liquid cartridge and a housing member. The liquid cartridge may contain liquid. The housing member may be constituted by a sheet-shaped member and house the liquid cartridge. The liquid cartridge may have an atmosphere introduction hole with which the atmosphere can be introduced to the inside. The housing member may have an end portion protruding toward a side in an opening direction of the atmosphere introduction hole. With the liquid container in this mode, an arrangement of the liquid cartridge at an arrangement angle at which the atmosphere introduction hole is oriented vertically downward is restricted by the end portion of the housing member.

[19] In the liquid container in the above mode, the liquid may contain a dispersoid component. The liquid cartridge may house a liquid holding member capable of holding the liquid, and have a liquid supply port with which the liquid can be supplied to the outside. The housing member may have, in addition to a first end portion that is the end portion, a second end portion that projects toward a side in an opening direction of the liquid supply port. With the liquid container in this mode, an arrangement of the liquid cartridge at an arrangement angle at which the atmosphere introduction hole or the liquid supply port is oriented vertically downward is restricted by the first end portion and the second end portion of the housing member.

[20] In the liquid container in the above mode, the liquid cartridge may be equipped with a cover member that covers the liquid supply port. With the liquid container in this mode, leakage of liquid via the liquid supply port is suppressed.

[21] In the liquid container in the above mode, the end portion may be an adhered portion formed by adhering end portions of the sheet-shaped member to each other. With the liquid container in this mode, since the strength of the end portions is enhanced, a function of restricting the arrangement angle and the arrangement position of the liquid cartridge by the end portion is enhanced.

[22] According to a fifth mode of the invention, a liquid container is provided. This liquid container may include a liquid cartridge, a housing member, and an exterior member. The liquid cartridge may house liquid containing a dispersoid component, and a liquid holding member capable of holding the liquid. The housing member may be constituted by a sheet-shaped member and house the liquid cartridge. The exterior member may be a box-shaped member that houses the liquid cartridge housed in the housing member. The liquid cartridge may have a liquid supply port with which the liquid can be supplied to the outside. The exterior member may have at least a wall portion located at a position opposed to the liquid supply port. The wall portion may have a projecting portion that projects in a direction extending from the liquid supply port toward the wall portion. The housing member may have an end portion located between the wall portion and the liquid cartridge. With the liquid container in this mode, an arrangement of the liquid cartridge at an arrangement angle at which the liquid supply port is oriented vertically downward is restricted by the projecting portion of the exterior member. For this reason, an uneven distribution of a dispersoid component in liquid on the side of the liquid supply port is suppressed, and occurrence of a concentration distribution of the dispersoid component is suppressed. Furthermore, a change of the arrangement position of the liquid cartridge within the exterior member is suppressed by the end portion of the housing member.

[23] According to a sixth mode of the invention, a liquid container is provided. This liquid container may include a liquid cartridge, a housing member, and an exterior member. The liquid cartridge may house liquid containing a dispersoid component, and a liquid holding member capable of holding the liquid. The housing member may be constituted by a sheet-shaped member and house the liquid cartridge. The exterior member may be a box-shaped member that houses the liquid cartridge housed in the housing member. The liquid cartridge may have a liquid supply port with which the liquid can be supplied to the outside. The exterior member may have at least a wall portion located at a position opposed to the liquid supply port. An outer wall surface of the wall portion may be constituted by one or more flat surfaces inclining with respect to a direction extending from the liquid supply port toward the wall portion. The housing member may have an end portion located between the wall portion and the liquid cartridge. With the liquid container in this mode, an arrangement of the liquid cartridge at an arrangement angle at which the liquid supply port is oriented vertically downward is restricted by the inclination of the outer wall surface of the wall portion. For this reason, an uneven distribution of a dispersoid component in liquid on the side of the liquid supply port is suppressed, and occurrence of a concentration distribution of the dispersoid component is suppressed. Furthermore, a change of the arrangement position of the liquid cartridge within the exterior member is suppressed by the end portion of the housing member.

[24] According to a seventh mode of the invention, a liquid container is provided. This liquid container may include a liquid cartridge, a housing member, and an exterior member. The liquid cartridge may house liquid containing a dispersoid component, and a liquid holding member capable of holding the liquid. The housing member may be constituted by a sheet-shaped member and house the liquid cartridge. The exterior member may be a box-shaped member that houses the liquid cartridge housed in the housing member. The liquid cartridge may have a liquid supply port with which the liquid can be supplied to the outside. The exterior member may have at least a wall portion located at a position opposed to the liquid supply port, and a protruding portion that extends so as to further project than a wall surface of the wall portion in a direction extending from the liquid supply port toward the wall portion. The housing member may have an end portion located between the wall portion and the liquid cartridge. With the liquid container in this mode, an arrangement of the liquid cartridge at an arrangement angle at which the liquid supply port is oriented vertically downward is restricted by the protruding portion of the exterior member. For this reason, an uneven distribution of a dispersoid component in liquid on the side of the liquid supply port is suppressed, and occurrence of a concentration distribution of the dispersoid component is suppressed. Furthermore, a change of the arrangement position of the liquid cartridge within the exterior member is suppressed by the end portion of the housing member.

[25] According to an eighth mode of the invention, a liquid container is provided. This liquid container may include a liquid cartridge and a housing member. The liquid cartridge may house liquid containing a dispersoid component, and a liquid holding member capable of holding the liquid. The housing member may be constituted by a sheet-shaped member and house the liquid cartridge. The housing member may have an end portion at a position opposed to the liquid supply port. The end portion may project in a direction extending from the liquid supply port toward the end portion. With the liquid container in this mode, an arrangement of the liquid cartridge at an arrangement angle at which the liquid supply port is oriented vertically downward is restricted by the end portion of the housing member. For this reason, an uneven distribution of a dispersoid component in liquid on the side of the liquid supply port is suppressed, and occurrence of a concentration distribution of the dispersoid component is suppressed. [26] According to a ninth mode of the invention, a liquid container is provided. This liquid container may include a liquid cartridge, a housing member, and an exterior member. The liquid cartridge may contain liquid. The housing member may be constituted by a sheet-shaped member and house the liquid cartridge. The exterior member may be a box-shaped member that houses the liquid cartridge housed in the housing member. The liquid cartridge may have a communication hole that is in communication with the inside. The exterior member may have at least a wall portion located at a position opposed to the communication hole. The wall portion may have a structure that guides the exterior member in a direction of falling down when the liquid container is about to be arranged with the wall portion as a bottom face. The housing member may have an end portion located between the wall portion and the liquid cartridge. With the liquid container in this mode, an arrangement of the liquid cartridge at an arrangement angle at which the communication hole is oriented vertically downward is restricted by the structure of the exterior member. Furthermore, a change of the arrangement position and the arrangement angle of the liquid cartridge within the exterior member is suppressed by the end portion of the housing member.

Not all of the plurality of constituent elements that each of the above-described modes of the invention has are essential, and modification, deletion, replacement with other new constituent components, and partial deletion of the limitation can be made as appropriate for some constituent components in the plurality of constituent components in order to solve a part or all of the foregoing problem, or to achieve some or all of the effects described in the specification. It is also possible to combine some or all of the technical features included in one of the above-described modes of the invention with some or all of the technical features included in the other of the above-described modes of the invention to make an independent mode of the invention, in order to solve a part or all of the foregoing problem, or to achieve some or all of the effects described in the specification.

The invention can also be achieved in various modes other than a liquid container. For example, the invention can be achieved in modes such as a member for packaging a liquid cartridge, a packaging method, a packaging apparatus, a computer program for achieving control of this apparatus, and a non-transitory recording medium recording this computer program.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
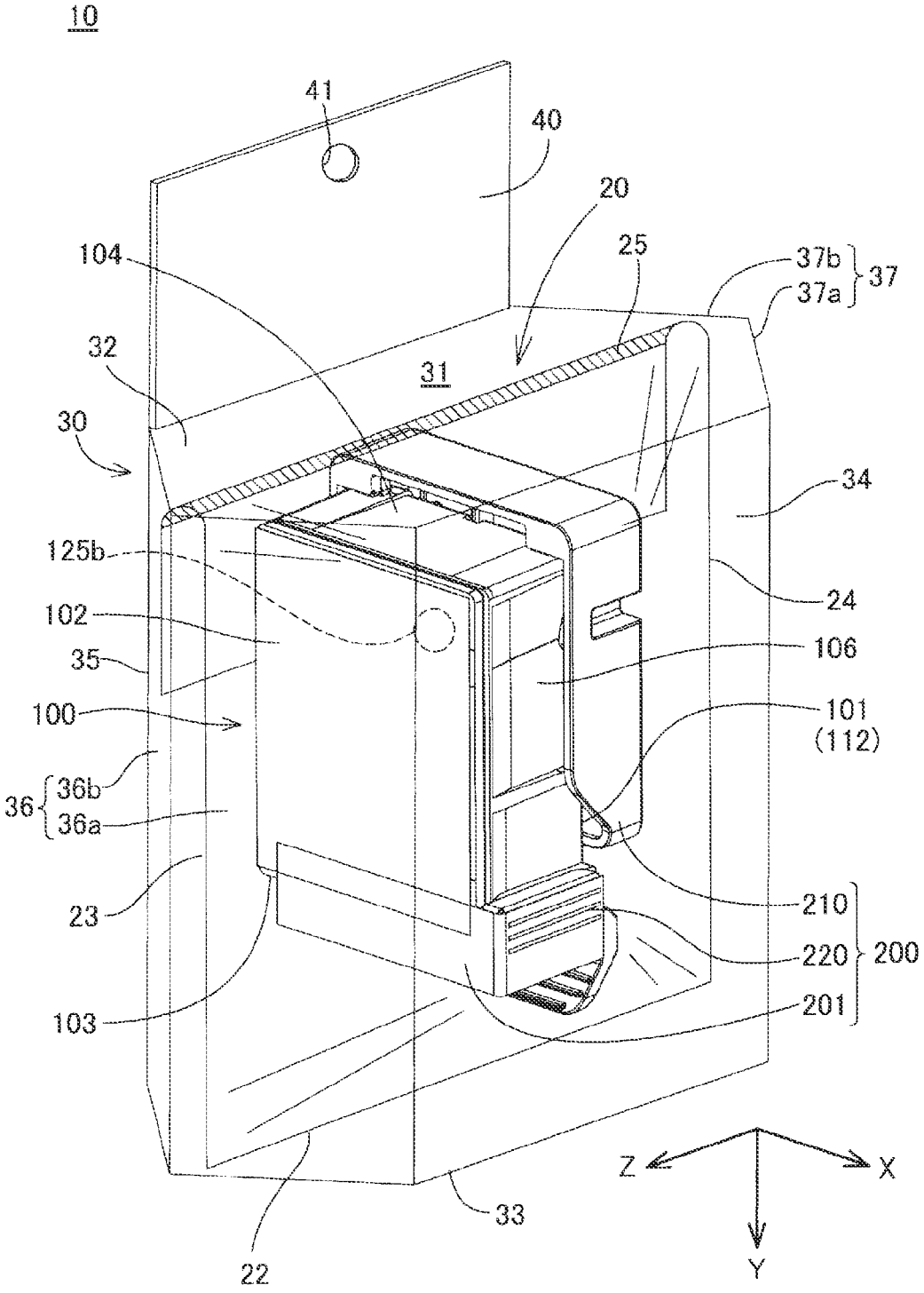
FIG. 1 is a schematic perspective view showing a configuration of a packaging body of a cartridge in a first embodiment.

FIG. 1 is a schematic perspective view showing a configuration of a packaging body 10 of an ink cartridge (hereinafter also referred to simply as a "cartridge"), which serves as a first embodiment of the invention. In FIG. 1, for the sake of convenience, a bag-shaped member 20 and a box-shaped member 30 are shown in a state where the inside thereof is visible. In FIG. 1, arrows X, Y, and Z indicating three directions orthogonal to one another with the cartridge 100 as a reference are shown. The arrows X, Y, and Z correspond to arrows X, Y, and Z, respectively, shown in the drawings used in the later description. The directions indicated by the arrows X, Y, and Z will be described later.

The packaging body 10 is a mode of a liquid container, and the cartridge 100 is packaged therein for the purpose of commercial distribution or the like. The packaging body 10 has a configuration in which an unused cartridge 100 is housed in the bag-shaped member 20 and the box-shaped member 30. The cartridge 100 corresponds to a liquid cartridge. The cartridge 100 is configured to be able to be installed in a printer, and contains ink to be supplied to the printer. A protection member 200 is attached to the cartridge 100. The bag-shaped member 20 corresponds to a housing member, and houses the cartridge 100. The box-shaped member 30 corresponds to an exterior member, and houses the cartridge 100 housed in the bag-shaped member 20.

In the packaging body 10 in this embodiment, the arrangement angle of the housed cartridge 100 is appropriately restricted by the configuration of the bag-shaped member 20 and the box-shaped member 30. The configuration of the cartridge 100 and the protection member 200 will be described below first, and thereafter a configuration of the packaging body 10 and an arrangement state of the cartridge 100 in the packaging body 10 will be described.

[Configuration of Cartridge and Protection Member]

Figure 2:
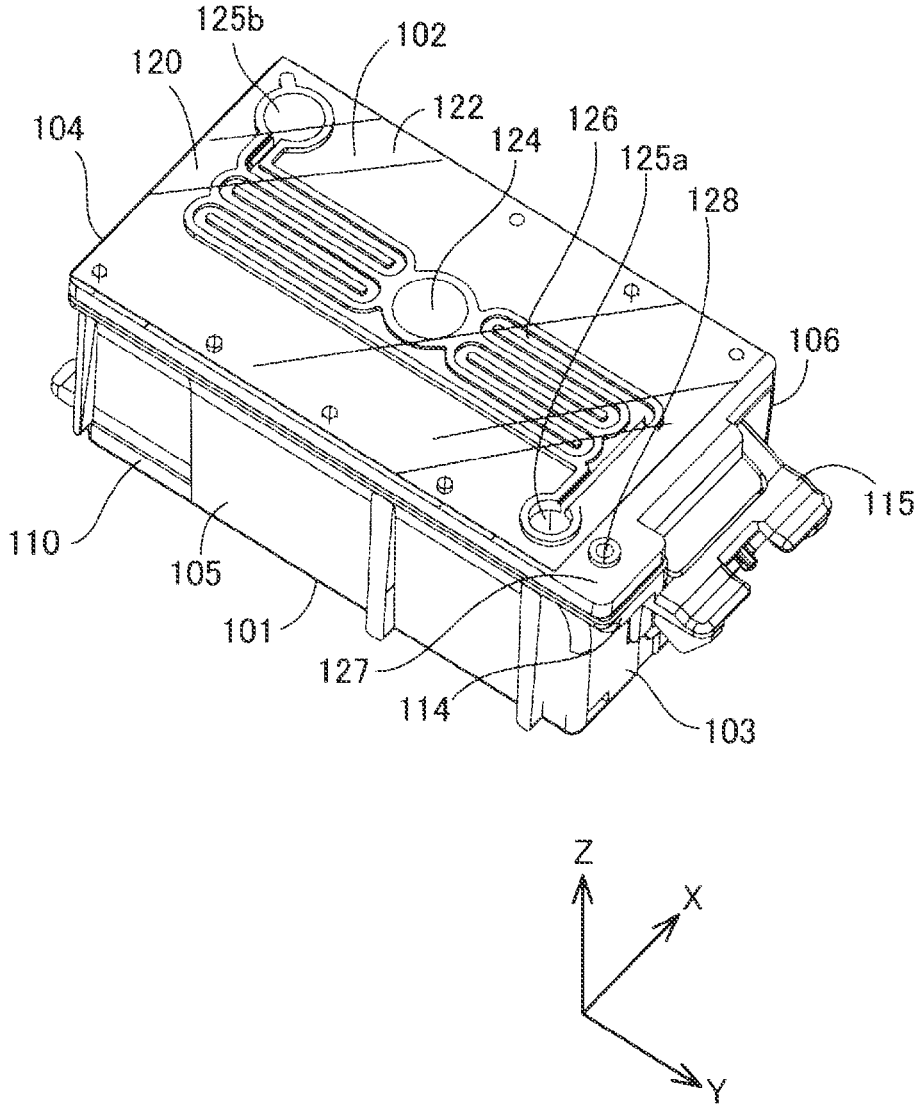
FIG. 2 is a schematic upper perspective view of the cartridge.
Figure 3:
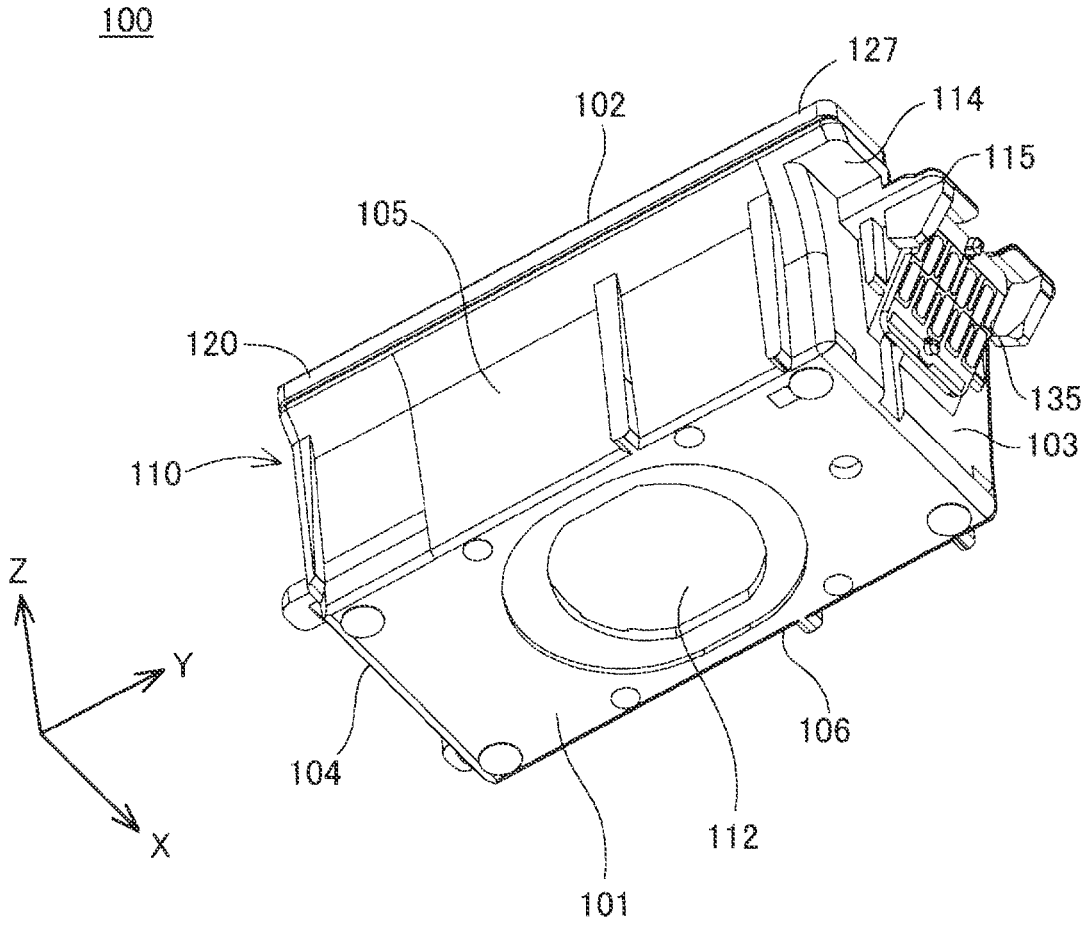
FIG. 3 is a schematic lower perspective view of the cartridge.
Figure 4:
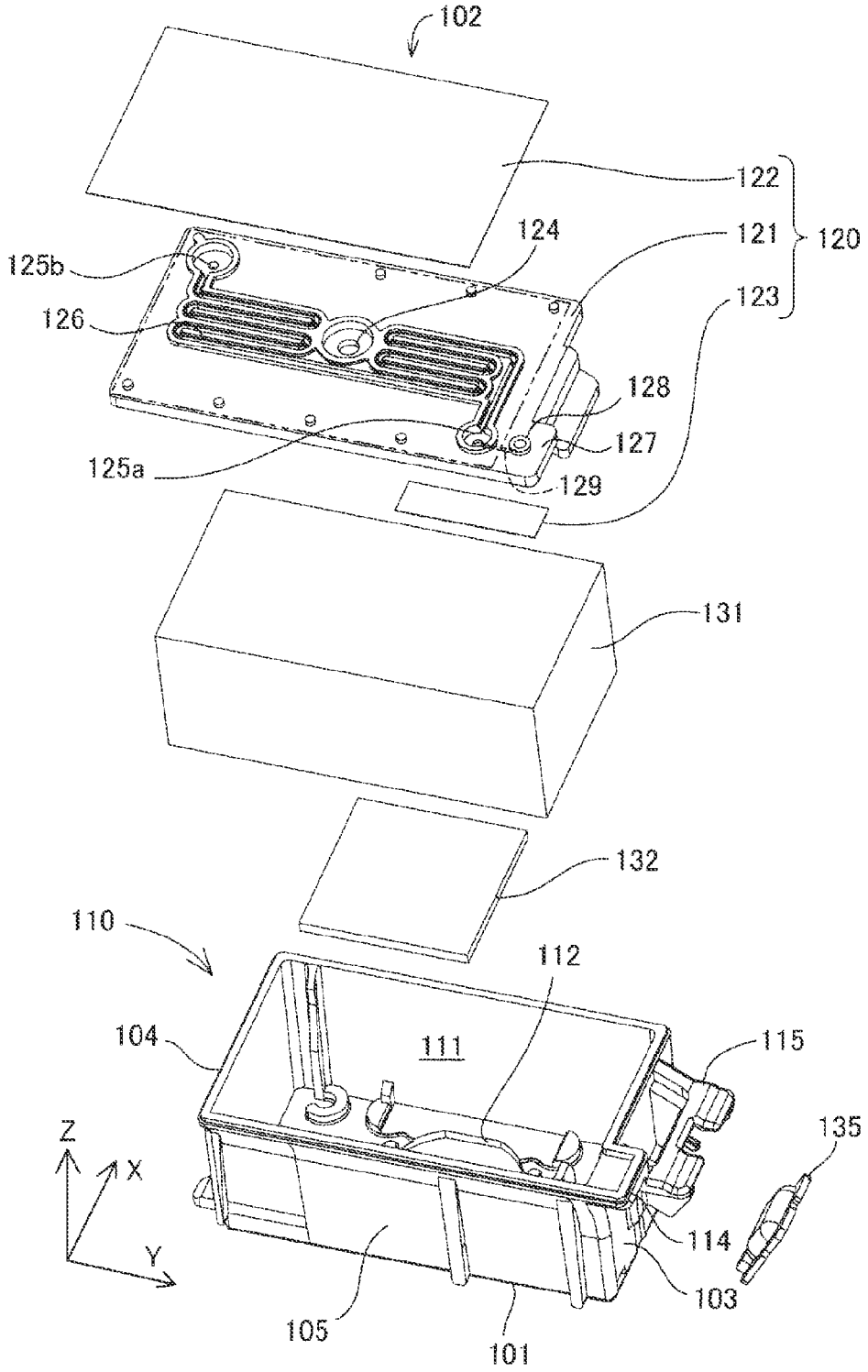
FIG. 4 is a schematic exploded perspective view of the cartridge.
Figure 5:
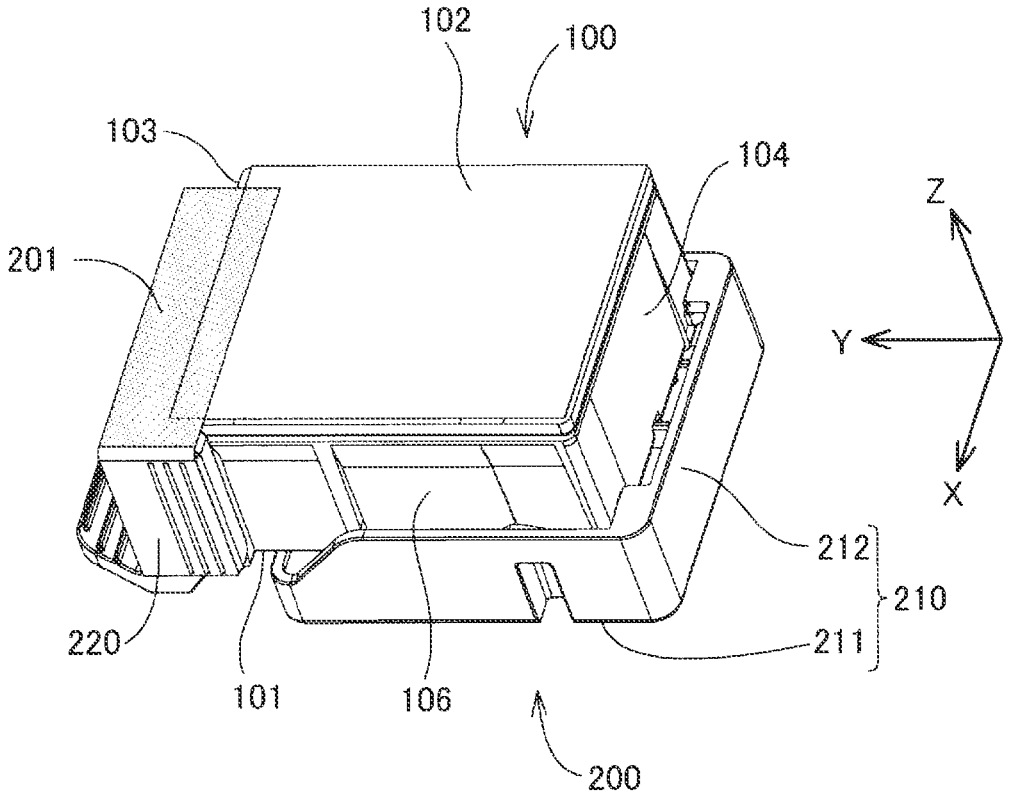
FIG. 5 is a schematic upper perspective view of the cartridge in a state where a protection member is attached thereto.

The configuration of the cartridge 100 and the protection member 200 will be described with reference to FIGS. 2 to 5. FIG. 2 is a schematic upper perspective view of the cartridge 100. FIG. 3 is a schematic lower perspective view of the cartridge 100. FIG. 4 is a schematic exploded perspective view showing the cartridge 100 in an exploded state. FIG. 5 is a schematic upper perspective view of the cartridge 100 in a state where the protection member 200 is attached thereto. In FIGS. 2 to 5, arrows X, Y, and Z indicating three directions orthogonal to one another are shown in a corresponding manner. The directions indicated by the arrows X, Y, and Z will be sequentially described. Note that the arrows X, Y, and Z correspond to arrows X, Y, and Z, respectively, shown in the drawings used in the later description.

The cartridge 100 in this embodiment has a substantially rectangular parallelepiped shape, and has six faces 101 to 106. A bottom face 101 is a face opposed to a carriage provided in the printer when the cartridge 100 is attached to the printer, and is a face that is oriented vertically downward. An upper face 102 is a face opposed to the bottom face 101. A front face 103 is a face intersecting the bottom face 101 and the upper face 102, and is a face that is oriented to a downstream side of a main scanning direction, which will be described later, when the cartridge 100 is installed in the printer.

A rear face 104 is a face intersecting the bottom face 101 and the upper face 102 and opposed to the front face 103, and is a face oriented to an upstream side in the main scanning direction when the cartridge 100 is installed in the printer. A left side face 105 is a face adjacent to the bottom face 101, the upper face 102, the front face 103, and the rear face 104, and is a face located to the left of the front face 103 when the front face 103 is seen straight with the bottom face 101 and the upper face 102 respectively on the lower side and the upper side. A right side face 106 is a face intersecting the bottom face 101 and the upper face 102, and is a face opposed to the left side face 105 with the front face 103 therebetween.

Here, the arrow X indicates a left-right direction (width direction), which is a direction in which the left side face 105 and the right side face 106 of the cartridge 100 face each other, and indicates a direction extending from the left side face 105 toward the right side face 106. The arrow X direction is parallel with a moving direction of the carriage (so-called sub-scanning direction) when the cartridge 100 is installed in the printer, and is orthogonal to the gravity direction (i.e., vertical direction).

The arrow Y indicates a direction parallel with a front-rear direction (depth direction), which is a direction in which the front face 103 and the rear face 104 of the cartridge 100 face each other, and indicates a direction extending from the side of the front face 103 toward the side of the rear face 104 of the cartridge 100. The arrow Y direction is parallel with a conveyance direction of printing paper (so-called main scanning direction) under the carriage when the cartridge 100 is installed in the printer, and is orthogonal to the gravity direction.

The arrow Z indicates an up-down direction (height direction) of the cartridge 100 in which the bottom face 101 and the upper face 102 face each other, and indicates a direction extending from the bottom face 101 toward the upper face 102 of the cartridge 100. The arrow Z direction is parallel with the gravity direction when the cartridge 100 is installed in the printer.

The cartridge 100 has a body container 110 that is open in one direction and is a hollow resin box body, and a lid portion 120 that covers the opening portion of the body container 110 (FIG. 4). In the cartridge 100, outer wall surfaces of respective wall portions of the body container 110 constitute the bottom face 101, the front face 103, the rear face 104, the left side face 105, and the right side face 106 of the cartridge 100, and an upper face of the lid portion 120 constitutes the upper face 102.

A space surrounded by the body container 110 and the lid portion 120 is an ink chamber 111 in which ink is contained. An ink supply port 112, which is a through hole that is in communication with the ink chamber 111, is formed roughly at the center of the bottom face 101 (FIG. 3). The ink supply port 112 corresponds to a liquid supply port, and the printer receives, via the ink supply port 112, the ink supplied from the cartridge 100. In this embodiment, the ink is pigment ink, and contains a pigment component that is a dispersoid component.

First and second ink holding members 131 and 132 are housed in the ink chamber 111 (FIG. 4). The first and second ink holding members 131 and 132 each correspond to a liquid holding member, and absorb the ink to the inside to hold the ink. The first and second ink holding members 131 and 132 are each constituted by a forming member such as urethane form, or a porous resin member such as a fiber member obtained by making polypropylene into a fibrous state and bundling it, for example.

The first ink holding member 131 has a substantially rectangular parallelepiped shape, and has a volume close to the volume of the ink chamber 111. The second ink holding member 132 has a substantially flat-plate shape. The second ink holding member 132 is arranged between the first ink holding member 131 and the ink supply port 112 so as to cover the ink supply port 112. The second ink holding member 132 is also called a "wick".

The first and second ink holding members 131 and 132 have different liquid holding characteristics. Specifically, the pore density of the first ink holding member 131 is set larger than the pore density of the second ink holding member 132 in order that capillary force of the second ink holding member 132 is larger than that of the first ink holding member 131. The ink in the ink chamber 111 thereby easily gathers to the ink supply port 112.

The lid portion 120 has a lid body portion 121 and first and second seal portions 122 and 123. The lid body portion 121 is constituted by a plate-shaped resin member. A center through hole 124 is provided roughly at the center of the lid body portion 121. The center through hole 124 is used as an ink injection hole during the manufacturing process of the cartridge 100. When the cartridge 100 is shipped from the factory, the center through hole 124 is in a state of being sealed by the first seal member 122.

When the lid body portion 121 is viewed in a direction opposite to the arrow Z direction, a first through hole 125*a* is provided at a corner portion sandwiched between the front face 103 and the left side face 105. A second through hole 125*b* is provided at a corner portion sandwiched between the rear face 104 and the right side face 106. The first and second through holes 125*a* and 125*b* are joined by a front face groove portion 126, which is a groove portion formed in an upper face of the lid body portion 121. The front face groove portion 126 bends substantially in a bellows shape as a result of being folded back several times in the arrow Y direction.

The first seal member 122 is constituted by a resin film member having a substantially rectangular shape, and is arranged on the upper face of the lid body portion 121. The first seal member 122 covers and seals opening portions of the center through hole 124, the first and second through holes 125*a* and 125*b*, and the front face groove portion 126 of the lid body portion 121. In FIG. 4, an area of the lid body portion 121 that is sealed by the first seal member 122 arranged therein is indicated by a chain double-dashed line.

The lid body portion 121 has an extending portion 127 at an end portion that intersects the front face 103. The extending portion 127 extends straight frontward from the area sealed by the first seal member 122 at a position adjacent to the left side face 105. In the extending portion 127, an atmosphere releasing hole 128 for bringing in the atmosphere is formed as a through hole opening in the arrow Z direction.

The atmosphere releasing hole 128 is formed so as to be adjacent to the first through hole 125*a* in the arrow Y direction. A back-face groove portion 129 (indicated by a broken line), which is a groove portion joining the atmosphere releasing hole 128 to the first through hole 125*a* is formed in the lower face of the lid body portion 121. A second seal member 123 is constituted by a resin film member having a substantially rectangular shape, and is arranged in the lower face of the lid body portion 121 so as to seal the opening portion of the aforementioned back face groove portion 129.

In the cartridge 100, the atmosphere releasing hole 128, the back face groove portion 129, the first and second through holes 125*a* and 125*b*, and the front face groove portion 126 constitute an atmosphere passage for introducing the atmosphere into the ink chamber 111. When the cartridge 100 is installed in the printer, the atmosphere releasing hole 128 enters a state of being exposed to the atmosphere so as to be able to bring in the atmosphere in the upper face 102. Upon the ink flowing out from the ink supply port 112 of the cartridge 100, the atmosphere is brought in from the atmosphere releasing hole 128 with a change of the pressure in the ink chamber 111.

The atmosphere flows from the atmosphere releasing hole 128 to the first through hole 125*a* via the back face groove portion 129, and flows into the front face groove portion 126 via the first through hole 125*a*. Then, the atmosphere flows in the front face groove portion 126 and is introduced into the ink chamber 111 via the second through hole 125*b*. Hereinafter, the first through hole 125*a* will also be referred to as an "atmosphere communication hole 125*a*", and the second through hole 125*b* will also be referred to as an "atmosphere introduction hole 125*b*".

When the cartridge 100 is installed in the printer, the ink chamber 111 in the cartridge 100 is in communication with the outside via the atmosphere releasing hole 128. In the cartridge 100 in this embodiment, the length of the passage from the ink chamber 111 to the outside of the cartridge 100 is secured as a result of the front face groove portion 126 being formed in a bent manner, and evaporation of the ink from the ink chamber 111 is suppressed.

An extension portion 114 and a carriage engaging portion 115 are formed in the front face 103 of the body container 110. The extension portion 114 extends in the arrow Y direction so as to correspond to the extending portion 127 of the lid portion 120. When the lid portion 120 is attached to the body container 110, the extending portion 127 is supported from below by the extension portion 114. The carriage engaging portion 115 is a portion to be engaged with an engaging mechanism of the carriage when the cartridge 100 is attached to the carriage. The carriage engaging portion 115 is formed as a substantially canopy-like portion that extends frontward near an upper end portion of the front face 103 at a substantially center position in the arrow X direction.

A circuit board 135 is arranged in a state of inclining so as to be oriented downward below the carriage engaging portion 115. The circuit board 135 is electrically connected to a terminal provided on the side of the printer when the cartridge 100 is installed in the carriage of the printer. When the cartridge 100 is installed, the printer receives, from the circuit board 135, an electric signal indicating an installation state of the cartridge 100 and information regarding the ink, such as the color and the amount of remaining ink contained in the cartridge 100.

In this embodiment, the protection member 200 is attached to the cartridge 100 (FIGS. 1 and 5). The protection member 200 has a function of sealing the atmosphere releasing hole 128 and the ink supply port 112 of the cartridge 100 before use, and a function of serving as a bumper portion for absorbing an impact or the like applied to the cartridge 100 when being conveyed. The protection member 200 has a film portion 201, a bottom face holder portion 210, and a support column portion 220.

The film portion 201 is constituted by a tape-like resin film member. One end of the film portion 201 is adhered to the upper face 102 of the cartridge 100, and the other end is adhered to an upper end of the support column portion 220. The film portion 201 seals the atmosphere releasing hole 128 of the cartridge 100 and fixes the support column portion 220.

The bottom face holder portion 210 corresponds to a cover member, and is attached in a fitting manner to the side of the bottom face 101 of the cartridge 100. The bottom face holder portion 210 has a bottom face portion 211 and a side wall portion 212. The bottom face portion 211 is arranged at a position opposed to the bottom face 101 of the cartridge 100. A seal member (not shown) that can seal the ink supply port 112 (FIG. 3) is arranged in the bottom face portion 211. The side wall portion 212 covers a lower end portion of the rear face 104, the left side face 105, and the right side face 106 of the cartridge 100 in a protecting manner.

The support column portion 220 extends in the arrow Z direction along a front end portion of the right side face 106 of the cartridge 100. As mentioned above, the film portion 201 is adhered to an upper end of the support column portion 220. The support column portion 220 is joined to the bottom face holder portion 210 via a joint portion (not shown).

When the protection member 200 is removed from the cartridge 100, a procedure for cancelling the sealed state of the ink supply port 112 and the atmosphere releasing hole 128 is provided as follows. When the film portion 201 is in a state of sealing the atmosphere releasing hole 128, the support column portion 220 is fixed by the film portion 201, and therefore the removal of the bottom face holder portion 210 from the cartridge 100 is restricted. On the other hand, upon the film portion 201 being detached from the upper face 102 of the cartridge 100 and the sealing of the atmosphere releasing hole 128 being cancelled, the fixation of the support column portion 220 is also cancelled, and accordingly the bottom face holder portion 210 can also be removed from the cartridge 100.

Thus, with the protection member 200, the procedure for cancelling the sealing of the ink supply port 112 by the bottom face holder portion 210 after the film portion 201 is detached and the sealing of the atmosphere releasing hole 128 is cancelled is provided. Accordingly, the entry of the atmosphere into the ink chamber 111 via the ink supply port 112 as a result of the sealing of the ink supply port 112 being cancelled before the cancellation of the sealing of the atmosphere releasing hole 128 is suppressed. Note that a part of or the entire protection member 200 may be omitted in the packaging body 10, and the cartridge 100 may be housed in the bag-shaped member 20 in a state where the protection member 200 is not attached to the cartridge 100.

[Packaged State of Cartridge in Packaging Body]

Figure 6:
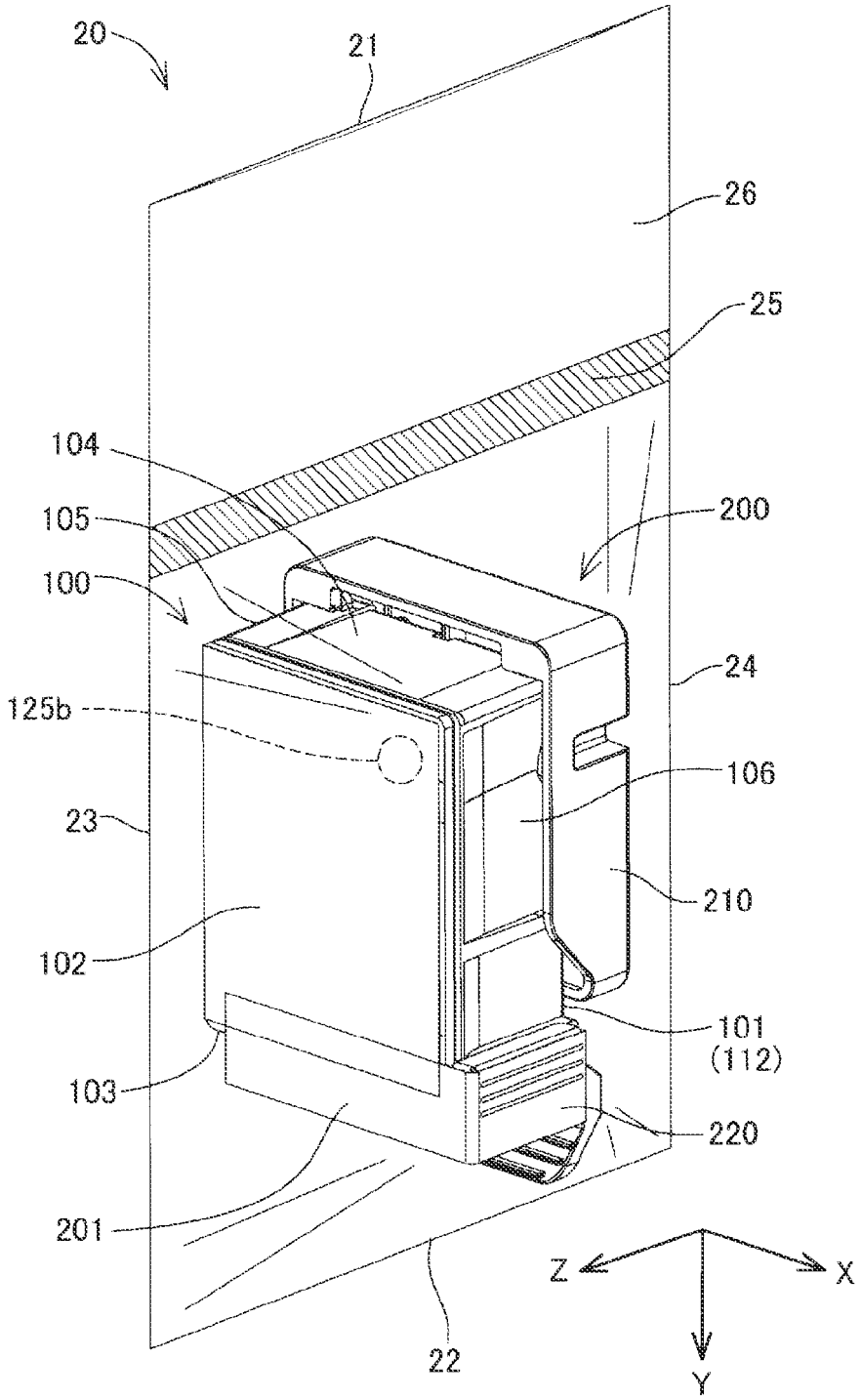
FIG. 6 is a schematic view for illustrating housing of the cartridge in a bag-shaped member.

A method for packaging the cartridge 100 will be described with reference to FIGS. 6 and 7. FIG. 6 is a schematic view for illustrating housing of the cartridge 100 in the bag-shaped member 20. In FIG. 6, for the sake of convenience, the bag-shaped member 20 is shown in a state where the inside thereof is visible. The bag-shaped member 20 has a configuration in which sheet-shaped flexible resin members (e.g., polyethylene or polyvinyl chloride) are overlaid with each other. Note that the material to constitute the bag-shaped member 20 is not limited to a resin member, and may be aluminum foil, for example. The bag-shaped member 20 has a substantially rectangular shape, and has four end side portions 21 to 24.

An opening portion that is in communication with the inside space of the bag-shaped member 20 is formed at a first end side portion 21, and is in a state of not being sealed before the cartridge 100 is housed in the bag-shaped member 20. A second end side portion 22 is located at a position opposed to the first end side portion 21, and third and fourth end side portions 23 and 24 are located at positions opposed to each other with the first and second end side portions 21 and 22 therebetween. The second to fourth end side portions 22 to 24 are sealed by adhesion before the cartridge 100 is housed.

The cartridge 100 is inserted straight in the inside space of the bag-shaped member 20 from the side of the front face 103 toward the second end side portion 22 via the opening portion of the first end side portion 21. The cartridge 100 is arranged such that the height direction thereof (arrow Z direction) roughly coincides with the direction in which the third end side portion 23 and the fourth end side portion 24 face each other in the inside space of the bag-shaped member 20.

The third end side portion 23 of the bag-shaped member 20 is thereby arranged at a position opposed to the upper face 102 of the cartridge 100 that has the atmosphere introduction hole 125*b*. The fourth end side portion 24 of the bag-shaped member 20 is arranged at a position opposed to the bottom face 101 of the cartridge 100 that has the ink supply port 112. The third and fourth end side portions 23 and 24 in this embodiment each correspond to an end portion of the bag-shaped member 20. In this embodiment, this end portion is also an adhered portion.

After the cartridge 100 is inserted, a sealed portion 25 is formed by adhesion at a portion between the rear face 104 of the cartridge 100 and the first end side portion 21, and the bag-shaped member 20 is tightly sealed. The sealed portion 25 is formed roughly parallel with the extending direction of the first end side portion 21. It is desirable that the inside space of the bag-shaped member 20 is decompressed before the bag-shaped member 20 is tightly sealed. It is thereby possible to suppress the entry of the atmosphere into the cartridge 100 before use and also to bring an inner surface of the bag-shaped member 20 into closer contact with the cartridge 100. Note that shrink packaging, by which the bag-shaped member 20 is subjected to heat shrinkage, may be applied to the packaging of the cartridge 100 using the bag-shaped member 20.

Figure 7:
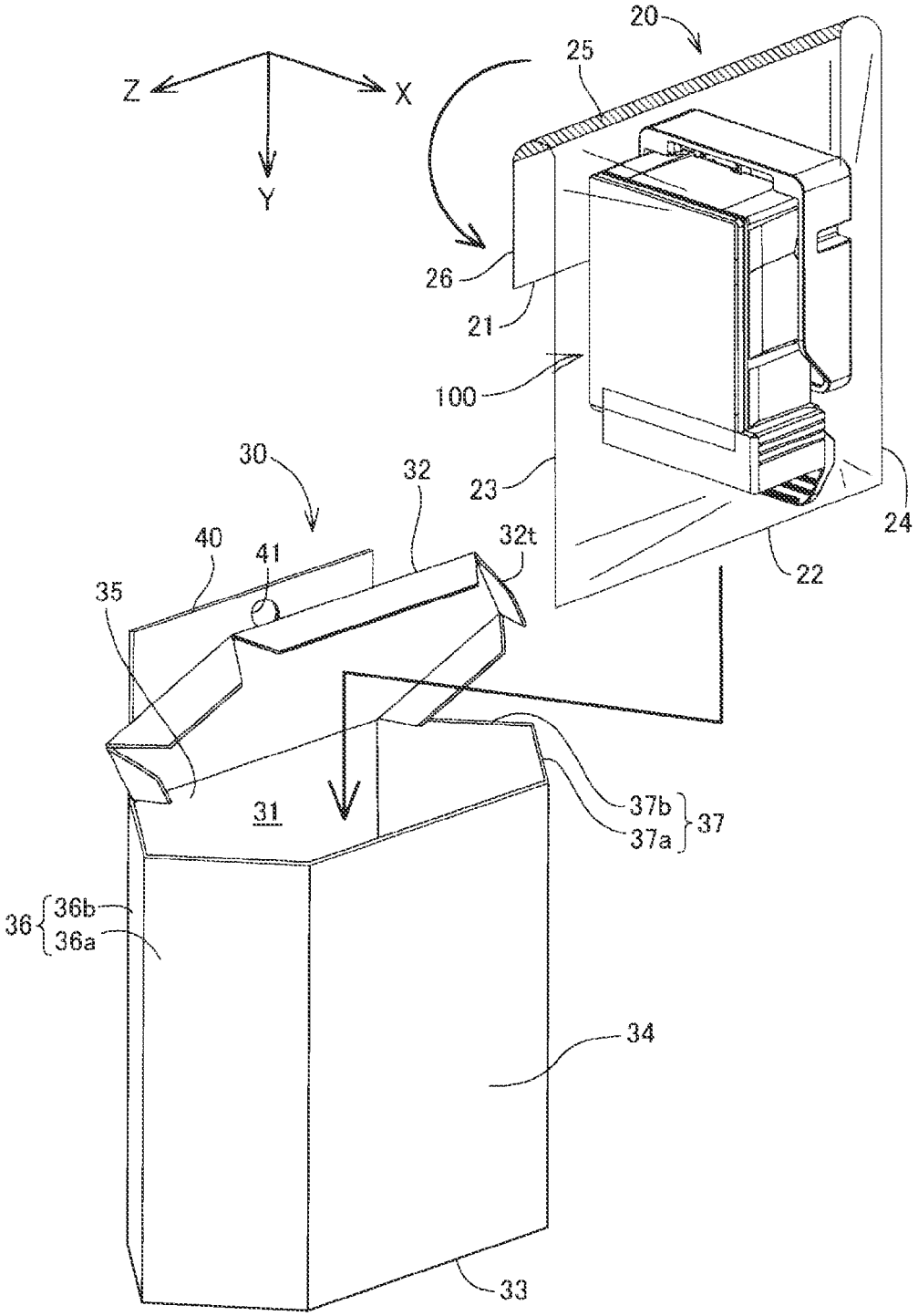
FIG. 7 is a schematic view for illustrating housing of the cartridge, which is housed in the bag-shaped member, in a box-shaped member.

FIG. 7 is a schematic view for illustrating the housing of the cartridge 100, which is housed in the bag-shaped member 20, in the box-shaped member 30. The box-shaped member 30 is a hollow box body having a housing space 31 for housing the cartridge 100, and is constituted by thick paper, for example. Note that the box-shaped member 30 may be constituted by a material other than thick paper, and may be constituted by a resin material, for example.

A main body portion of the box-shaped member 30 has a substantially hexagonal prism shape, and the housing space 31 has a substantially hexagonal cross-section. The box-shaped member 30 has an upper face wall portion 32, a bottom face wall portion 33, a front face wall portion 34, a back face wall portion 35, a first side wall portion 36, and a second side wall portion 37, as wall portions surrounding the housing space 31.

The upper face wall portion 32 and the bottom face wall portion 33 are flat wall portions constituting an upper face and a bottom face of the hexagonal prism. The upper face wall portion 32 and the bottom face wall portion 33 have substantially hexagonal shapes of roughly the same size, and are arranged parallel with each other. One side of the upper face wall portion 32 is joined to an upper end of the back face wall portion 35, and functions as an openable and closable lid portion. A plurality of tongue piece portions 32*t* are provided in the outer periphery of the upper face wall portion 32. When the upper face wall portion 32 is closed, the tongue piece portions 32*t* are housed in the housing space 31 so as to come into surface contact with inner wall surfaces of the respective wall portions 34, 35, 36, and 37 that are adjacent to the upper face wall portion 32.

The front face wall portion 34, the back face wall portion 35, the first side wall portion 36, and the second side wall portion 37 are wall portions constituting side faces of the hexagonal prism, and roughly vertically intersect the upper face wall portion 32 and the bottom face wall portion 33. The front face wall portion 34 and the back face wall portion 35 have substantially rectangular wall surfaces of roughly the same size, and are arranged parallel with each other.

The first side wall portion 36 and the second side wall portion 37 are arranged at positions that face each other with the front face wall portion 34 and the back face wall portion 35 therebetween. The first side wall portion 36 and the second side wall portion 37 each have a configuration in which one wall surface is bent into two portions, and respectively have two intersecting flat outer wall surfaces 36*a* and 36*b* and two intersecting flat outer wall surfaces 37*a* and 37*b*. The first outer wall surface 36*a* of the first side wall portion 36 and the first outer wall surface 37*a* of the second side wall portion 37 are located at positions adjacent to the front face wall portion 34, and the second outer wall surface 36*b* of the first side wall portion 36 and the second outer wall surface 37*b* of the second side wall portion 37 are located at positions adjacent to the back face wall portion 35.

In this embodiment, the outer wall surfaces 36*a*, 36*b*, 37*a*, and 37*b* of the first side wall portion 36 and the second side wall portion 37 have roughly the same areas, and have smaller areas than the areas of the outer wall surfaces of the front face wall portion 34 and the back face wall portion 35. The first outer wall surface 36*a* of the first side wall portion 36 and the second outer wall surface 37*b* of the second side wall portion 37 are arranged roughly parallel with each other, and the second outer wall surface 36*b* of the first side wall portion 36 and the first outer wall surface 37*a* of the second side wall portion 37 are arranged roughly parallel with each other.

The back face wall portion 35 is provided with a roughly rectangular extending portion 40. The extending portion 40 further extends in a direction extending from the bottom face wall portion 33 toward the upper face wall portion 32 than the outer wall surface of the upper face wall portion 32 in a closed state. A through hole 41 for hanging the packaging body 10 on a hook or the like is provided in the extending portion 40.

The bag-shaped member 20 housing the cartridge 100 is inserted into the housing space 31 of the box-shaped member 30 in a state where an extension portion 26 that is present in an extended manner between the first end side portion 21 and the sealed portion 25 is bent toward the side of the second end side portion 22. The second end side portion 22 of the bag-shaped member 20 is arranged so as to face the bottom face wall portion 33. The third end side portion 23 is arranged at a corner portion between the outer wall surfaces 36*a* and 36*b* of the first side wall portion 36, and the fourth end side portion 24 is arranged at a corner portion between the outer wall surfaces 37*a* and 37*b* of the second side wall portions 37. After the cartridge 100 housed in the bag-shaped member 20 is housed in the housing space 31 of the box-shaped member 30, the upper face wall portion 32 is closed, and the sealed portion 25 of the bag-shaped member 20 faces the upper face wall portion 32.

Figure 8:
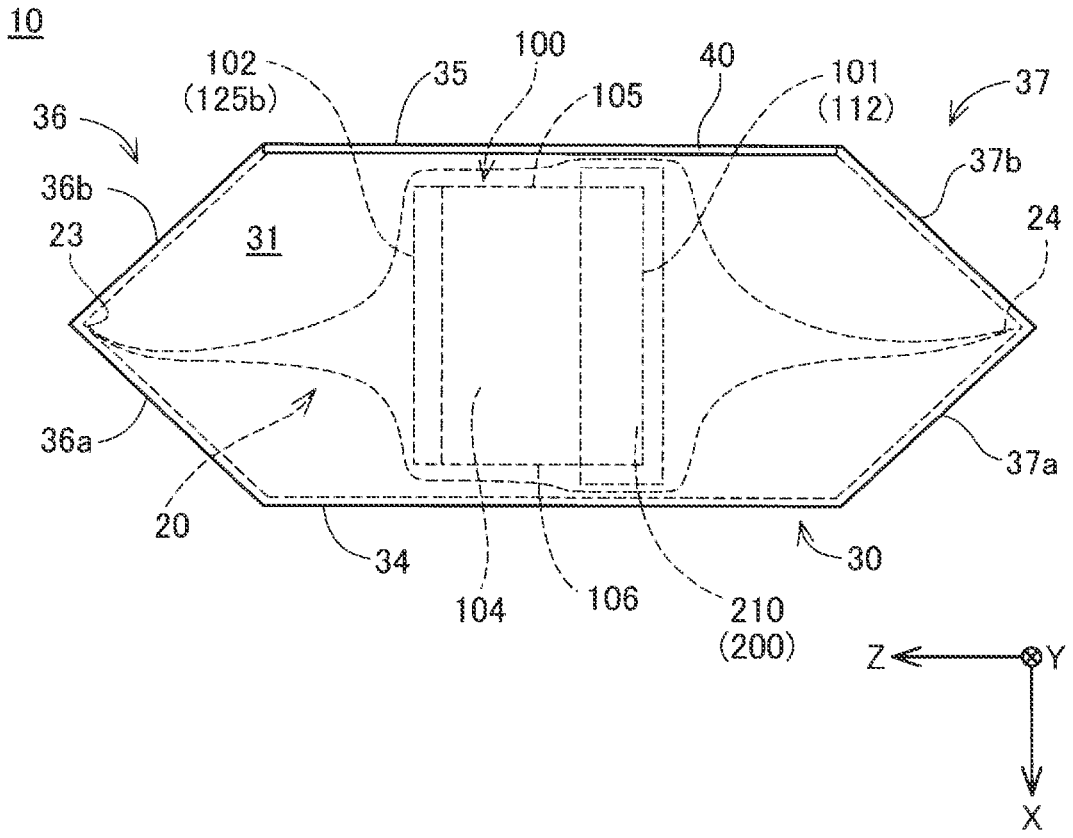
FIG. 8 is a schematic view for illustrating a packaged state of the cartridge in the packaging body.

A packaged state of the cartridge 100 in the packaging body 10 will be described with reference to FIGS. 1 and 8. FIG. 8 is a schematic view showing the packaging body 10 as viewed in a direction extending from the upper face wall portion 32 toward the bottom face wall portion 33 of the box-shaped member 30. In FIG. 8, for the sake of convenience, the bag-shaped member 20 and the cartridge 100 housed in the box-shaped member 30 are indicated by broken lines.

In the packaging body 10 in this embodiment, the first side wall portion 36 is arranged at a position opposed to the atmosphere introduction hole 125*b* of the cartridge 100. In the first side wall portion 36, the first and second outer wall surfaces 36*a* and 36*b* intersect each other and constitute a projecting portion that projects in a direction (arrow Z direction) extending from the atmosphere introduction hole 125*b* toward the first side wall portion 36. The first and second outer wall surfaces 36*a* and 36*b* correspond to two flat surfaces inclining with respect to the direction extending from the atmosphere introduction hole 125*b* toward the first side wall portion 36.

Since the overall first side wall portion 36 projects outward (in the arrow Z direction), the packaging body 10 in this embodiment cannot be caused to stably stand straight on a horizontal surface with the first side wall portion 36 on a bottom face side. That is to say, in the packaging body 10 in this embodiment, the arrangement of the cartridge 100 at an arrangement angle at which the opening direction of the atmosphere introduction hole 125*b* is oriented vertically downward is restricted. An outflow of the ink in the ink chamber 111 to the front face groove portion 126 via the atmosphere introduction hole 125*b* is thereby suppressed in the cartridge 100 before being installed in the printer. Accordingly, an increase in the amount of pressure loss in the front face groove portion 126 due to ink that has leaked via the atmosphere introduction hole 125*b*, and a resulting degradation of the characteristic of the outflow of the ink from the ink supply port 112 when printing using the cartridge 100 are suppressed.

In the packaging body 10 in this embodiment, the second side wall portion 37 is arranged at a position opposed to the ink supply port 112 of the cartridge 100. In the second side wall portion 37, the first and second outer wall surfaces 37*a* and 37*b* intersect each other and constitute a projecting portion that projects in a direction (a direction opposite to the arrow Z direction) extending from the ink supply port 112 toward the second side wall portion 37. The first and second outer wall surfaces 37*a* and 37*b* correspond to two flat surfaces inclining with respect to the direction extending from the ink supply port 112 toward the second side wall portion 37.

Since the overall second side wall portion 37 projects outward (in a direction opposite to the arrow Z direction), the packaging body 10 in this embodiment cannot be caused to stably stand straight on a horizontal surface with the second side wall portion 37 as a bottom face. That is to say, the arrangement at an arrangement angle at which the opening direction of the ink supply port 112 of the cartridge 100 is oriented vertically downward is restricted. Occurrence of a concentration gradient in which the concentration of a pigment component becomes higher toward the side of the ink supply port 112 due to sedimentation of the pigment component is thereby suppressed in the cartridge 100 before being installed in the printer.

When a concentration distribution of the pigment component in which the concentration becomes higher in a direction other than the direction extending toward the side of the ink supply port 112 has occurred in the cartridge 100 before use, movement of the pigment component in the ink is promoted by a change of the arrangement angle of the cartridge 100 when being installed in the printer. Accordingly, occurrence of an uneven concentration in a printed image caused by the concentration distribution of the pigment component of the ink in the cartridge 100 is suppressed.

In the packaging body 10 in this embodiment, the bottom face wall portion 33, the front face wall portion 34, and the back face wall portion 35 of the box-shaped member 30 each have a flat wall surface that does not have a projecting portion. For this reason, in the packaging body 10 in this embodiment, stable arrangement on a horizontal surface can be achieved with any of these wall portions 33 to 35 as a bottom face. If the packaging body 10 is arranged with any of the aforementioned wall portions 33 to 35 on the bottom face side, an arrangement at an arrangement angle at which the opening direction of the atmosphere introduction hole 125*b* or the ink supply port 112 is oriented vertically downward is suppressed.

In this embodiment, in the cartridge 100, the atmosphere introduction hole 125*b* and the ink supply port 112 are open in opposite directions. For this reason, if the packaging body 10 is arranged with any of the aforementioned wall portions 33 to 35 on the bottom face side, the opening directions of both the atmosphere introduction hole 125*b* and the ink supply port 112 simultaneously are directions other than the vertically downward direction.

In the packaging body 10 in this embodiment, the extending portion 40 is provided on the side of the upper face wall portion 32 of the box-shaped member 30, and the extending portion 40 is provided with the through hole 41 for hanging the packaging body 10 with the side of the upper face wall portion 32 as the vertically upper side. Thus, the packaging body 10 in this embodiment has a configuration with which the packaging body 10 is guided so as to be arranged with the side of the upper face wall portion 32 as the upper side.

In the cartridge 100 in this embodiment, the atmosphere introduction hole 125*b* is formed in the upper face 102 of the cartridge 100 at a position close to the rear face 104, which corresponds to an end portion of the cartridge 100. In the box-shaped member 30 in this embodiment, the upper face wall portion 32 corresponds to an atmosphere introduction hole side wall portion that is arranged at a position close to the atmosphere introduction hole 125*b*, and the bottom face wall portion 33 corresponds to an atmosphere introduction hole-separate wall portion that is arranged at a position separate from the atmosphere introduction hole 125*b*.

When the packaging body 10 is arranged with the side of the upper face wall portion 32 as the upper side, as in the case where the packaging body 10 is hung using the through hole 41 in the extending portion 40 or arranged with the bottom face wall portion 33 as a bottom face, the atmosphere introduction hole 125*b* is arranged on the upper side in the gravity direction. Accordingly, leakage of the ink from the atmosphere introduction hole 125*b* toward the front face groove portion 126 is further suppressed.

In the packaging body 10 in this embodiment, the third end side portion 23 of the bag-shaped member 20 is arranged between the first side wall portion 36 of the box-shaped member 30 and the cartridge 100. Thereby, even when the arrangement angle of the packaging body 10 is changed, a change of the arrangement position and the arrangement angle of the cartridge 100 with respect to the first side wall portion 36 is suppressed as a result of the third end side portion 23 of the bag-shaped member 20 being locked at the inner wall surface of the box-shaped member 30. In this specification, "to be locked" means to come into contact with an object so as to engage therewith and stop.

Similarly, in the packaging body 10 in this embodiment, the fourth end side portion 24 of the bag-shaped member 20 is arranged between the second side wall portion 37 and the cartridge 100. Thereby, even when the arrangement angle of the packaging body 10 is changed, a change of the arrangement position and the arrangement angle of the cartridge 100 with respect to the second side wall portion 37 is suppressed as a result of the fourth end side portion 24 of the bag-shaped member 20 being locked at the inner wall surface of the box-shaped member 30. In the bag-shaped member 20 in this embodiment, since the third end side portion 23 and the fourth end side portion 24 are constituted as adhered portions, the rigidity thereof is enhanced, and the supporting characteristic thereof with respect to the cartridge 100 is enhanced.

In the packaging body 10 in this embodiment, the third end side portion 23 of the bag-shaped member 20 is housed at the corner portion formed between the first and second outer wall surfaces 36*a* and 36*b* of the first side wall portion 36. The fourth end side portion 24 is housed at the corner portion formed between the first and second outer wall surfaces 37*a* and 37*b* of the second side wall portion 37. The end side portions 23 and 24 can thereby be easily locked by the inner wall surface of the box-shaped member 30, and the stability of the arrangement of the cartridge 100 within the box-shaped member 30 is enhanced. The housing density within the box-shaped member 30 is also enhanced, and the efficiency of usage of the inside space is enhanced.

In the packaging body 10 in this embodiment, the front face wall portion 34 of the box-shaped member 30 and the bag-shaped member 20 are in a state of being roughly in contact with each other at a position adjacent to the right side face 106 of the cartridge 100. Also, the back face wall portion 35 of the box-shaped member 30 and the bag-shaped member 20 are in a state of being roughly in contact with each other at a position adjacent to the left side face 105 of the cartridge 100. Thus, in the packaging body 10 in this embodiment, the cartridge 100 is in a state of being roughly sandwiched by the front face wall portion 34 and the back face wall portion 35 of the box-shaped member 30 via the bag-shaped member 20, and a change of the arrangement position and the arrangement angle of the cartridge 100 within the box-shaped member 30 is further suppressed.

In this embodiment, the bag-shaped member 20 is configured such that the width between the third end side portion 23 and the fourth end side portion 24 is roughly equal to or larger than the distance between the apex of the corner portion of the first side wall portion 36 and the apex of the corner portion of the second side wall portion 37. The third end side portion 23 and the fourth end side portion 24 of the bag-shaped member 20 can thereby be more easily locked by the inner wall surfaces of the first side wall portion 36 and the second side wall portion 37 of the box-shaped member 30, and the stability of the arrangement position of the cartridge 100 within the box-shaped member 30 is further enhanced.

In this embodiment, the bag-shaped member 20 is configured such that the length between the second end side portion 22 and the sealed portion 25 is larger than or equal to the distance between the upper face wall portion 32 and the bottom face wall portion 33 of the box-shaped member 30. The upper face wall portion 32 of the box-shaped member 30 and the sealed portion 25 of the bag-shaped member 20 are thereby in a state of being roughly in contact with each other, and the stability of the arrangement position of the cartridge 100 within the box-shaped member 30 is further enhanced. In particular, in this embodiment, the sealed portion 25 located at the apex of the bent portion also functions as an impact absorbing portion. For this reason, the characteristic of protection of the cartridge 100 against an impact applied to the packaging body 10 from the outside is enhanced.

Figure 9:
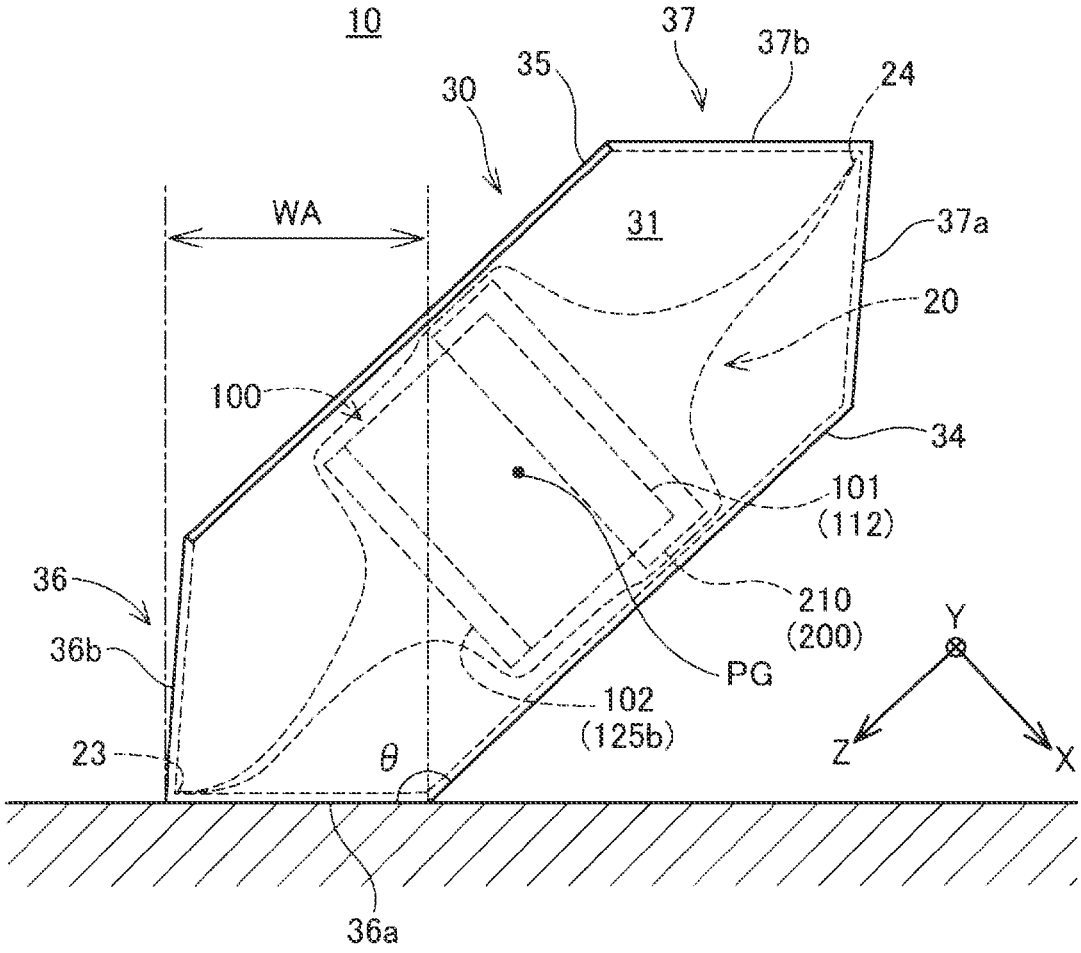
FIG. 9 is a schematic view for illustrating the position of the center of gravity of the packaging body.

FIG. 9 is a schematic view for illustrating the position of the center of gravity PG of the packaging body 10. FIG. 9 is the same as FIG. 8 except that the packaging body 10 is arranged on a horizontal surface with the first outer wall surface 36*a* of the first side wall portion 36 of the box-shaped member 30 as a bottom face and that the position of the center of gravity PG of the packaging body 10 and a region WA are shown. In the packaging body 10 in this embodiment, the cartridge 100 is housed at a roughly middle position between the first side wall portion 36 and the second side wall portion 37, and the center of gravity PG of the packaging body 10 is located roughly in the middle between the first side wall portion 36 and the second side wall portion 37.

The packaging body 10 in this embodiment is configured such that, when the packaging body 10 is arranged with the first outer wall surface 36*a* of the first side wall portion 36 as a bottom face, the center of gravity PG is located outside an arrangement region WA of the first outer wall surface 36*a* as viewed in a direction parallel with the vertical direction. Note that the position of the center of gravity PG in the case where the packaging body 10 is arranged with the first outer wall surface 36*a* as a bottom face can be adjusted using the angle θ between the front face wall portion 34 and the first outer wall surface 36*a*, for example.

As a result of the center of gravity PG being located at the aforementioned position, when arranging the packaging body 10 with the first outer wall surface 36*a* as a bottom face, the packaging body 10 is likely to fall down in a direction in which the front face wall portion 34 comes into contact with a placement surface. This also applies to the cases of arranging the packaging body 10 with the second outer wall surface 36*b* of the first side wall portion 36 as a bottom face and arranging the packaging body 10 with the first outer wall surface 37*a* or the second outer wall surface 37*b* of the second side wall portion 37 as a bottom face. Thus, in the packaging body 10 in this embodiment, an arrangement at an arrangement angle at which the atmosphere introduction hole 125*b* or the ink supply port 112 of the cartridge 100 is oriented downward is also suppressed by the position of the center of gravity PG of the packaging body 10.

[Summary of First Embodiment]

As described above, with the packaging body 10 in the first embodiment, the packaging body 10 cannot be caused to stably stand straight when being placed on a horizontal surface with the first side wall portion 36 or the second side wall portion 37 on the bottom face side and is guided toward a direction of falling down, due to a projecting structure of the outer wall surfaces of the box-shaped member 30. Accordingly, an arrangement of the cartridge 100 at an arrangement angle at which the atmosphere introduction hole 125*b* or the ink supply port 112 is oriented vertically downward is suppressed. Furthermore, the stability of the arrangement position of the cartridge 100 within the box-shaped member 30 is enhanced by the end portions of bag-shaped member 20. Accordingly, in the cartridge 100 before use, leakage of the ink from the atmosphere introduction hole 125*b* toward the front face groove portion 126 and an uneven distribution of the pigment component on the side of the ink supply port 112 are suppressed.

[B. Second Embodiment]

Figure 10:
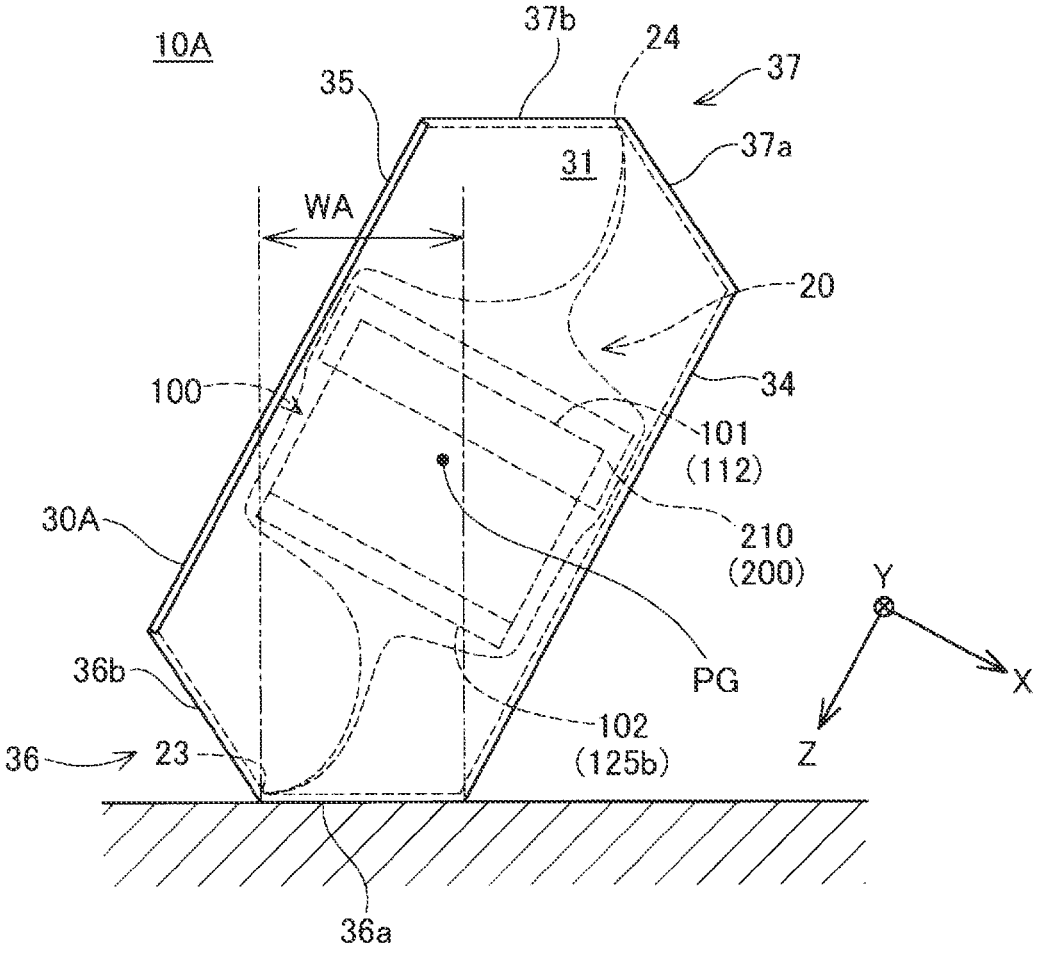
FIG. 10 is a schematic view showing a configuration of a packaging body in a second embodiment.

FIG. 10 is a schematic view of a packaging body 10A, which serves as a second embodiment of the invention, as viewed in a direction extending from the upper face wall portion 32 toward the bottom face wall portion 33 of the box-shaped member 30. In FIG. 10, as in FIG. 9, the packaging body 10A is shown in a state of being arranged with the first outer wall surface 36*a* of the first side wall portion 36 of a box-shaped member 30A as a bottom face. The packaging body 10A in the second embodiment is roughly the same as the packaging body 10 in the first embodiment except that the configuration of the box-shaped member 30A has been changed such that the position of the center of gravity PG when the packaging body 10A is arranged with the outer wall surface 36*a*, 36*b*, 37*a*, or 37*b* of the first side wall portion 36 or the second side wall portion 37 as a bottom face is different.

When the packaging body 10A in the second embodiment is arranged with the outer wall surface 36*a*, 36*b*, 37*a*, or 37*b* of the first side wall portion 36 or the second side wall portion 37 as a bottom face, the center of gravity PG is located within the arrangement region WA of the outer wall surface 36*a*, 36*b*, 37*a*, or 37*b* that serves as the bottom face. In the case of this configuration as well, with the packaging body 10A in the second embodiment, the state of arrangement thereof with the first side wall portion 36 or the second side wall portion 37 on the bottom face side is instable, and the packaging body 10A is guided toward a direction of falling down due to the projecting structure of the first side wall portion 36 or the second side wall portion 37. Accordingly, an arrangement with which the atmosphere introduction hole 125*b* or the ink supply port 112 is oriented downward is suppressed. Furthermore, a change of the arrangement position and the arrangement angle of the cartridge 100 within the box-shaped member 30 due to the end portions of the bag-shaped member 20 is suppressed. Additionally, the packaging body 10A in the second embodiment can achieve the same effects as those of the packaging body 10 in the first embodiment.

[C. Third Embodiment]

Figure 11:
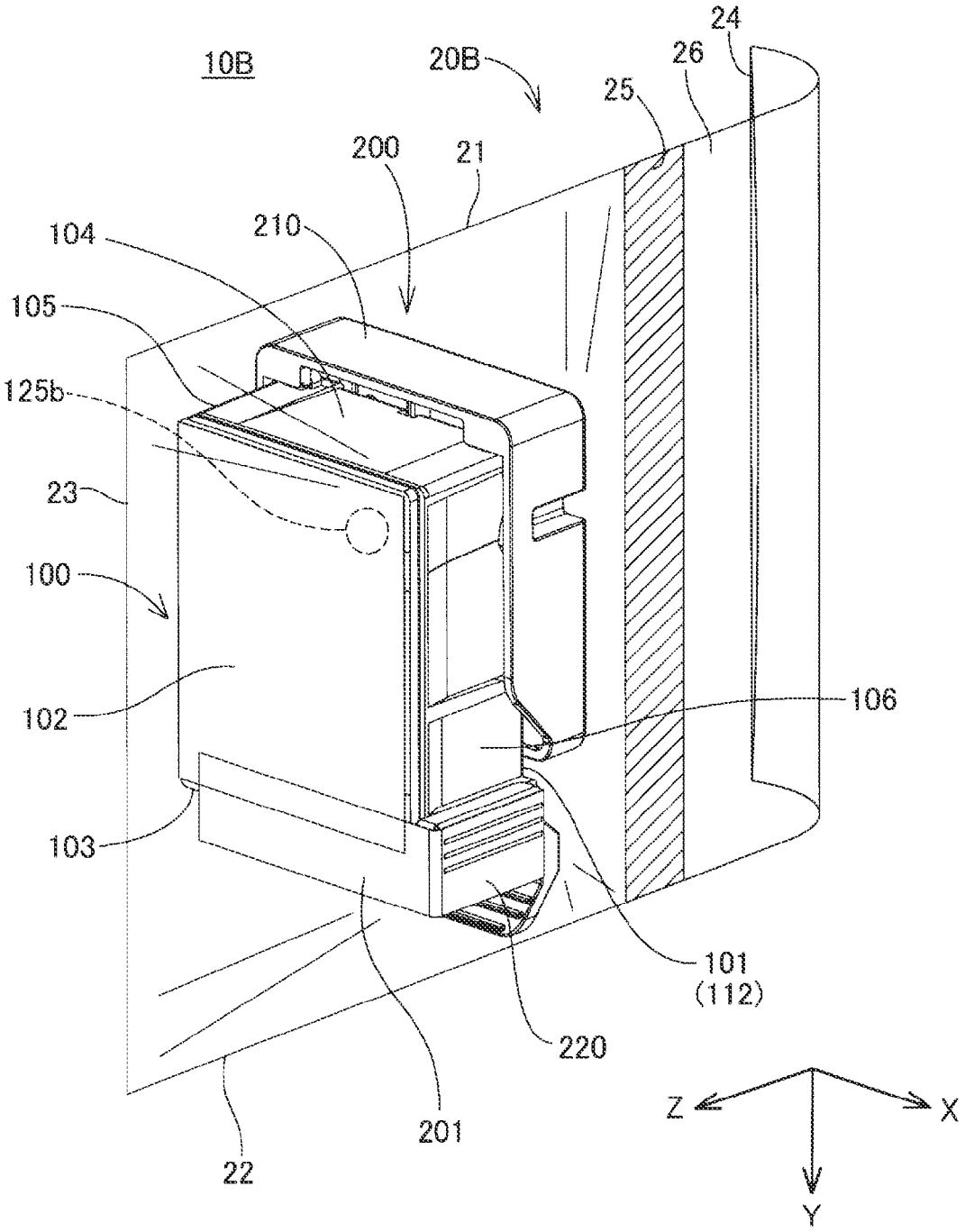
FIG. 11 is a schematic view for illustrating a configuration of a packaging body in a third embodiment.
Figure 12:
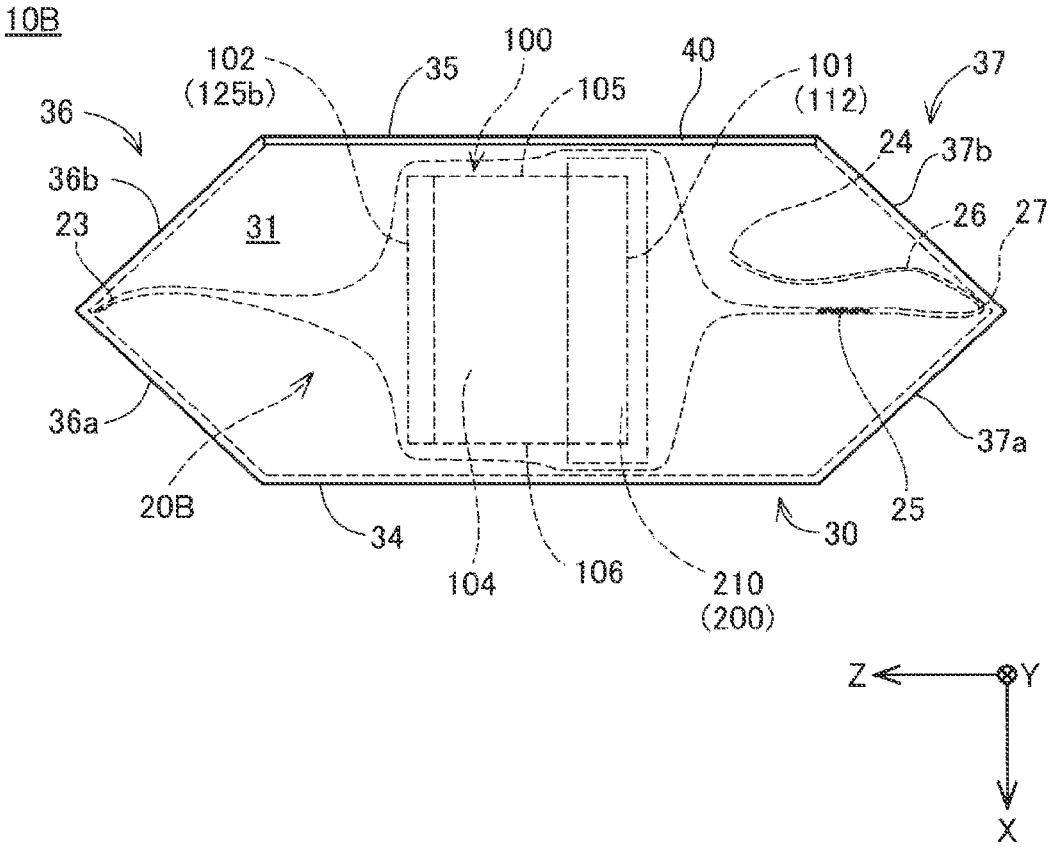
FIG. 12 is a schematic view for illustrating a configuration of the packaging body in the third embodiment.

FIGS. 11 and 12 are schematic views for illustrating a configuration of a packaging body 10B in a third embodiment. FIG. 11 shows a bag-shaped member 20B in the third embodiment in a state of housing the cartridge 100. FIG. 12 shows the packaging body 10B in the third embodiment as viewed in a direction extending from the upper face wall portion 32 toward the bottom face wall portion 33 of the box-shaped member 30. In FIG. 12, for the sake of convenience, the cartridge 100 and the bag-shaped member 20B housed in the box-shaped member 30 are indicated by broken lines. The packaging body 10B in the third embodiment has roughly the same configuration as that of the packaging body 10 in the first embodiment except that the configuration of the bag-shaped member 20B is different, and that the housing state of the box-shaped member 30 is different in a manner described below.

In the bag-shaped member 20B in the third embodiment, the sealed portion 25 and the extension portion 26 are formed not on the side of the first end side portion 21 but on the side of the fourth end side portion 24 that faces the ink supply port 112 (FIG. 11). Also, in the packaging body 10B in the third embodiment, a bent portion 27, which is formed by bending the extension portion 26, is arranged as an end portion of the bag-shaped member 20 between the cartridge 100 and the second side wall portion 37 of the box-shaped member 30. The bent portion 27 is housed at the corner portion formed between the first and second outer wall surfaces 37*a* and 37*b* of the second side wall portion 37.

In the packaging body 10B in the third embodiment, the characteristic of locking by the end portion of the bag-shaped member 20B on the side of the ink supply port 112 is enhanced. Furthermore, since the bent portion 27 of the bag-shaped member 20 functions as an impact absorbing portion, the protection characteristic on the side of the bottom face 101 of the cartridge 100 is enhanced. Additionally, the packaging body 10B in the third embodiment can achieve the same effects as those of the packaging body 10 in the first embodiment.

[D. Fourth Embodiment]

Figure 13:
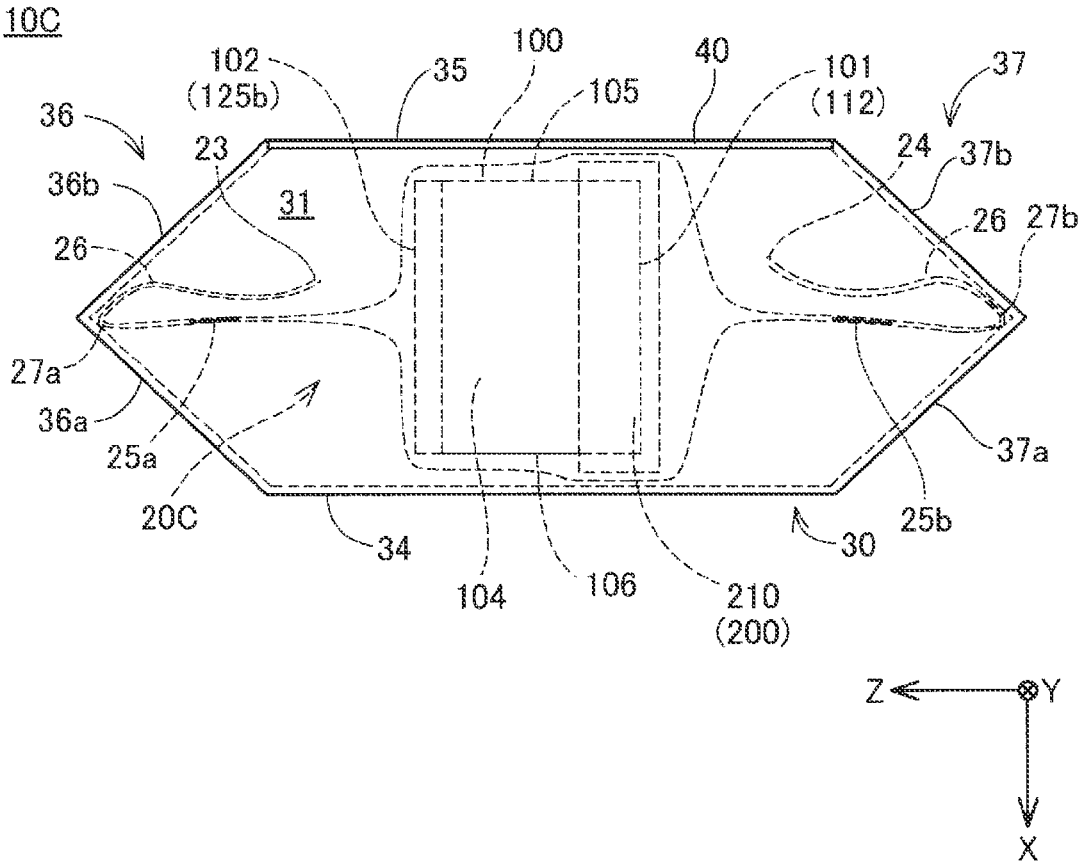
FIG. 13 is a schematic view showing a configuration of a packaging body in a fourth embodiment.

FIG. 13 is a schematic view showing a configuration of a packaging body 10C, which serves as a fourth embodiment of the invention. FIG. 13 shows the packaging body 10C in the fourth embodiment as viewed in a direction extending from the upper face wall portion 32 toward the bottom face wall portion 33 of the box-shaped member 30. In FIG. 13, for the sake of convenience, the cartridge 100 and the bag-shaped member 20C housed in the box-shaped member 30 are indicated by broken lines. The packaging body 10C in the fourth embodiment has roughly the same configuration as that of the packaging body 10B in the third embodiment except the points described below.

A bag-shaped member 20C in the fourth embodiment has a sealed portion 25*a* and a bent portion 27*a* that are provided on the side of the third end side portion 23, and a sealed portion 25*b* and a bent portion 27*b* that are provided on the side of the fourth end side portion 24. The bent portion 27*a* on the side of the third end side portion 23 is housed at the corner portion between the first and second outer wall surfaces 36*a* and 36*b* of the first side wall portion 36, and the bent portion 27*b* on the side of the fourth end side portion 24 is housed at the corner portion between the first and second outer wall surfaces 37*a* and 37*b* of the second side wall portion 37. The bent portion 27*a* corresponds to an end portion of the bag-shaped member 20C arranged between the first side wall portion 36 and the cartridge 100, and the bent portion 27*b* corresponds to an end portion of the bag-shaped member 20C arranged between the second side wall portion 37 and the cartridge 100.

In the packaging body 10C in the fourth embodiment, the characteristic of locking by the end portions of the bag-shaped member 20C on the side of the atmosphere introduction hole 125*b* as well as the characteristic of locking by the end portions of the bag-shaped member 20C on the side of the ink supply port 112 are enhanced. Furthermore, since the two bent portions 27 of the bag-shaped member 20C each function as an impact absorbing portion, the protection characteristic on the sides of the bottom face 101 and the upper face 102 of the cartridge 100 is enhanced. Additionally, the packaging body 10C in the fourth embodiment can achieve the same effects as those of the packaging body 10B in the third embodiment.

[E. Fifth Embodiment]

Figure 14:
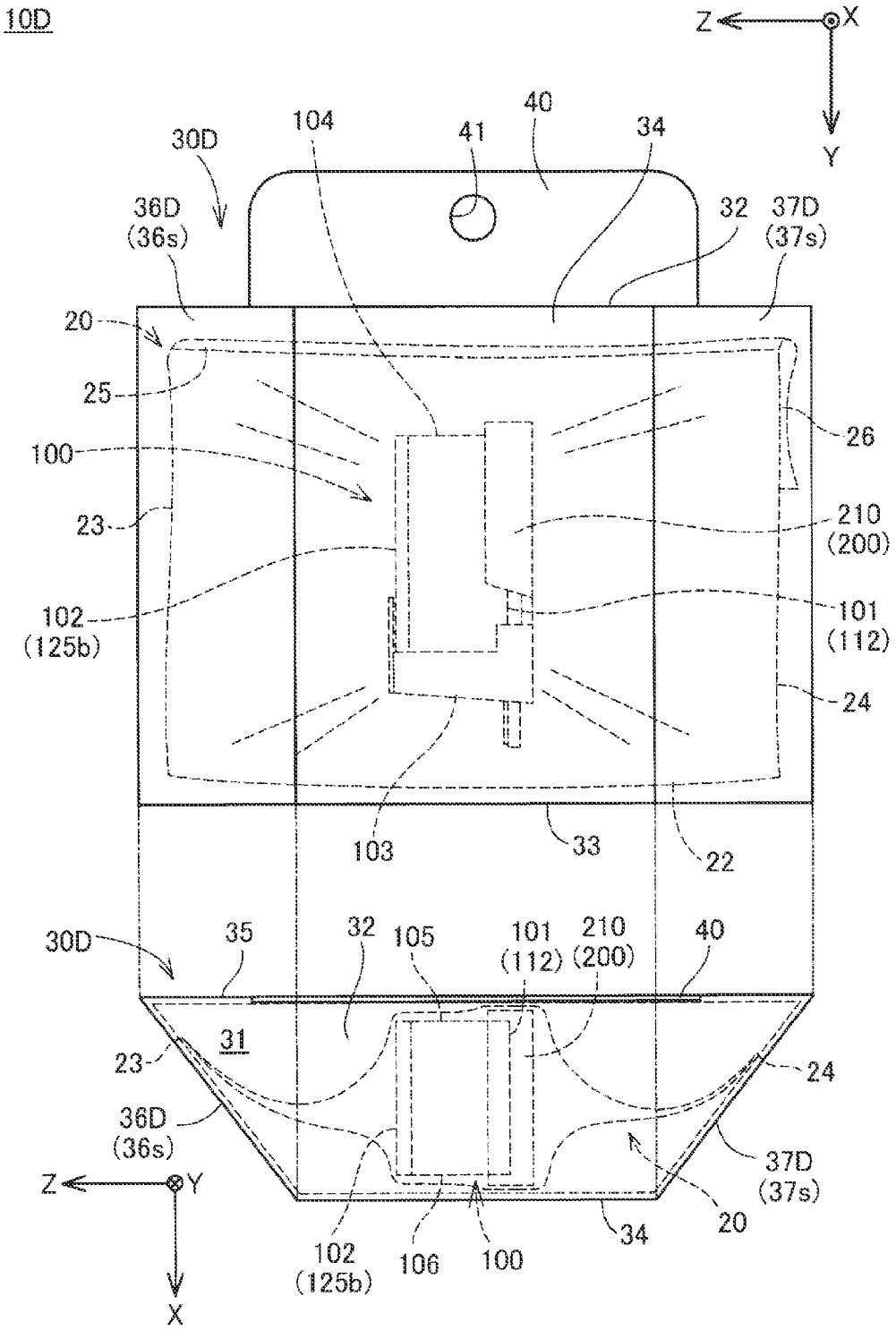
FIG. 14 is a schematic view showing a configuration of a packaging body in a fifth embodiment.

FIG. 14 is a schematic view showing a configuration of a packaging body 10D, which serves as a fifth embodiment of the invention. The upper part of FIG. 14 shows the packaging body 10D in the fifth embodiment as viewed in a direction extending from the front face wall portion 34 toward the back face wall portion 35, and the lower part shows the packaging body 10D in the fifth embodiment as viewed in a direction extending from the upper face wall portion 32 toward the bottom face wall portion 33. In FIG. 14, for the sake of convenience, the cartridge 100 and the bag-shaped member 20 housed in a box-shaped member 30D are indicated by broken lines. The packaging body 10D in the fifth embodiment has roughly the same configuration as that of the packaging body 10 in the first embodiment except that the packaging body 10D has the box-shaped member 30D whose shape is different.

The main body of the box-shaped member 30D in the fifth embodiment has a quadrangular prism shape whose upper face and bottom face are substantially trapezoidal, and the housing space 31 of the box-shaped member 30D has a substantially trapezoidal cross-section. In the box-shaped member 30D in the fifth embodiment, both the upper face wall portion 32 and the bottom face wall portion 33 have substantially trapezoidal shapes of roughly the same size. The front face wall portion 34 and the back face wall portion 35 have substantially rectangular wall surfaces parallel with each other. However, the width of the back face wall portion 35 in a direction extending from the first side wall portion 36 toward the second side wall portion 37 is larger than that of the front face wall portion 34.

A first side wall portion 36D has a first inclined outer wall surface 36*s*, which is a flat surface inclining with respect to a direction extending from the atmosphere introduction hole 125*b* of the cartridge 100 toward the first side wall portion 36D. A second side wall portion 37D has a second inclined outer wall surface 37*s*, which is a flat surface inclining with respect to a direction extending from the ink supply port 112 of the cartridge 100 toward the second side wall portion 37D. In the packaging body 10D in the fifth embodiment, the third end side portion 23 of the bag-shaped member 20 is arranged so as to be able to be locked at an inner wall surface of the first side wall portion 36D, and the fourth end side portion 24 is arranged so as to be able to be locked at an inner wall surface of the second side wall portion 37D.

With the packaging body 10D in the fifth embodiment, as a result of provision of the first inclined outer wall surface 36*s* of the first side wall portion 36, an arrangement at an arrangement angle at which the atmosphere introduction hole 125*b* of the cartridge 100 is oriented vertically downward is suppressed. Furthermore, with the packaging body 10D in the fifth embodiment, as a result of provision of the second inclined outer wall surface 37*s* of the second side wall portion 37D, an arrangement at an arrangement angle at which the ink supply port 112 of the cartridge 100 is oriented vertically downward is suppressed.

It is desirable that the packaging body 10D in the fifth embodiment is configured such that, when being arranged with the first inclined outer wall surface 36*s* or the second inclined outer wall surface 37*s* as a bottom face, the center of gravity of the packaging body 10D is located outside an arrangement region of the bottom face as viewed in a direction parallel with the vertical direction. With this configuration, when arranging the packaging body 10D with the first inclined outer wall surface 36*s* or the second inclined outer wall surface 37*s* as a bottom face, the packaging body 10D is highly likely to fall down in a direction in which the front face wall portion 34 comes into contact with a placement surface. Accordingly, an arrangement at an arrangement angle at which the atmosphere introduction hole 125*b* or the ink supply port 112 of the cartridge 100 is oriented downward is suppressed.

As described above, with the packaging body 10D in the fifth embodiment, an arrangement of the cartridge 100 at an arrangement angle at which the atmosphere introduction hole 125*b* or the ink supply port 112 is oriented downward is suppressed by the first inclined outer wall surface 36*s* and the second inclined outer wall surface 37*s* of the box-shaped member 30D. Furthermore, the packaging body 10D in the fifth embodiment can achieve the same effects as those of the packaging body 10 in the first embodiment.

[F. Sixth Embodiment]

Figure 15:
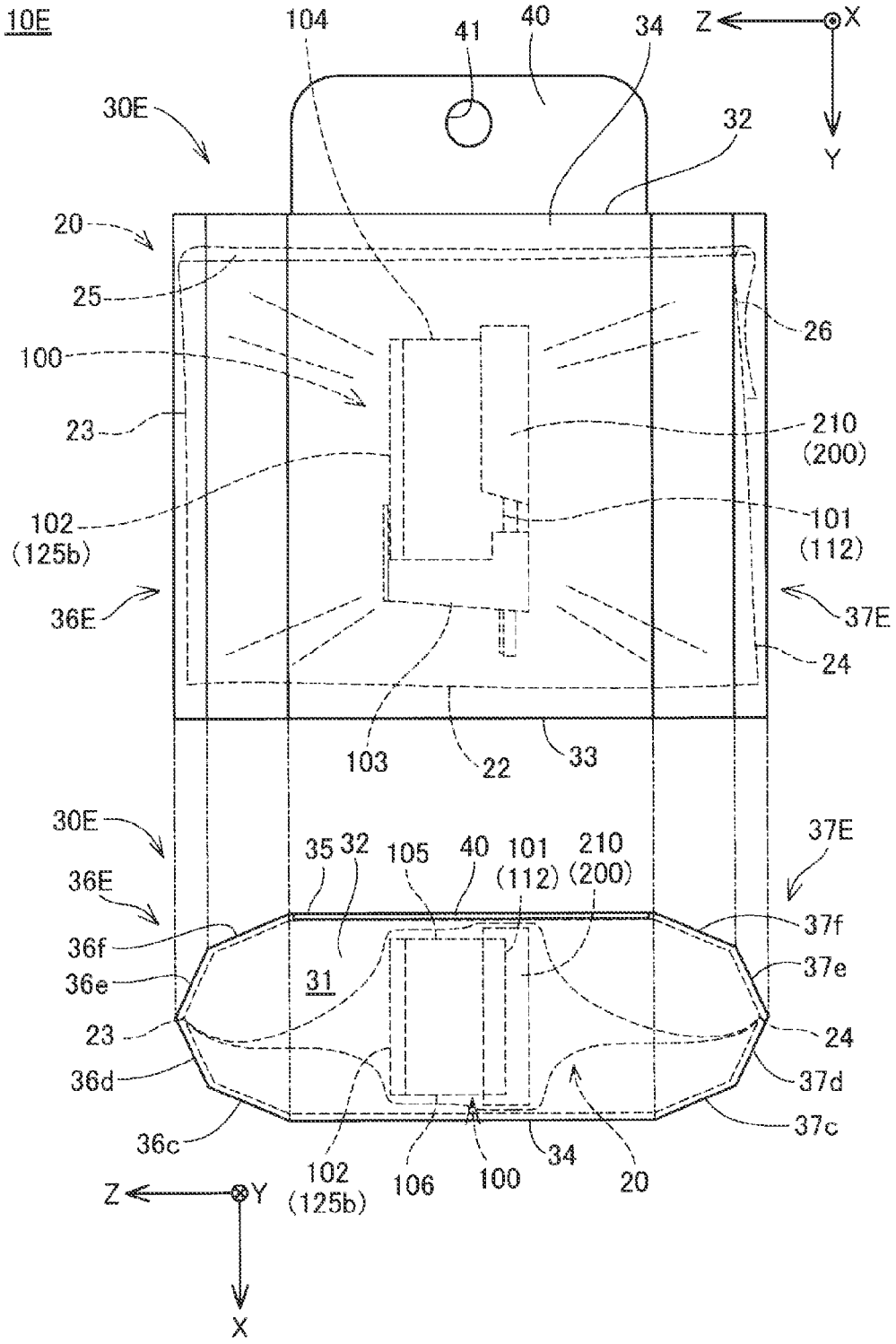
FIG. 15 is a schematic view showing a configuration of a packaging body in a sixth embodiment.

FIG. 15 is a schematic view showing a configuration of a packaging body 10E, which serves as a sixth embodiment of the invention. The upper part of FIG. 15 shows the packaging body 10E in the sixth embodiment as viewed in a direction extending from the front face wall portion 34 toward the back face wall portion 35, and the lower part shows the packaging body 10E in the sixth embodiment as viewed in a direction extending from the upper face wall portion 32 toward the bottom face wall portion 33. In FIG. 15, for the sake of convenience, the cartridge 100 and the bag-shaped member 20 housed in a box-shaped member 30E are indicated by broken lines. The packaging body 10E in the sixth embodiment has roughly the same configuration as that of the packaging body 10 in the first embodiment except that the packaging body 10E has the box-shaped member 30E whose shape is different.

The main body of the box-shaped member 30E in the sixth embodiment has a substantially decagonal prism shape, and the housing space 31 thereof has a substantially decagonal cross-section. In the box-shaped member 30E in the sixth embodiment, a projecting portion that is projected outward by four outer wall surfaces 36*c*, 36*d*, 36*e* and 36*f* sequentially arranged at different angles from the side of the front face wall portion 34 toward the side of the back face wall portion 35 is formed in the first side wall portion 36E. In the second side wall portion 37E as well, a projecting portion that is projected outward by four outer wall surfaces 37*c*, 37*d*, 37*e* and 37*f* sequentially arranged at different angles from the side of the front face wall portion 34 toward the side of the back face wall portion 35 is formed. The third end side portion 23 of the bag-shaped member 20 is housed in an inside space formed by the projecting portion of the first side wall portion 36, and the fourth end side portion 24 is housed in an inside space formed by the projecting portion of the second side wall portion 37.

With the packaging body 10E in the sixth embodiment, an arrangement of the cartridge 100 at an arrangement angle at which the atmosphere introduction hole 125*b* or the ink supply port 112 is oriented vertically downward is suppressed by a projecting structure of the first side wall portion 36E and the second side wall portion 37E. Additionally, the packaging body 10E in the sixth embodiment can achieve the same effects as those of the packaging body 10 in the first embodiment.

[G. Seventh Embodiment]

Figure 16:
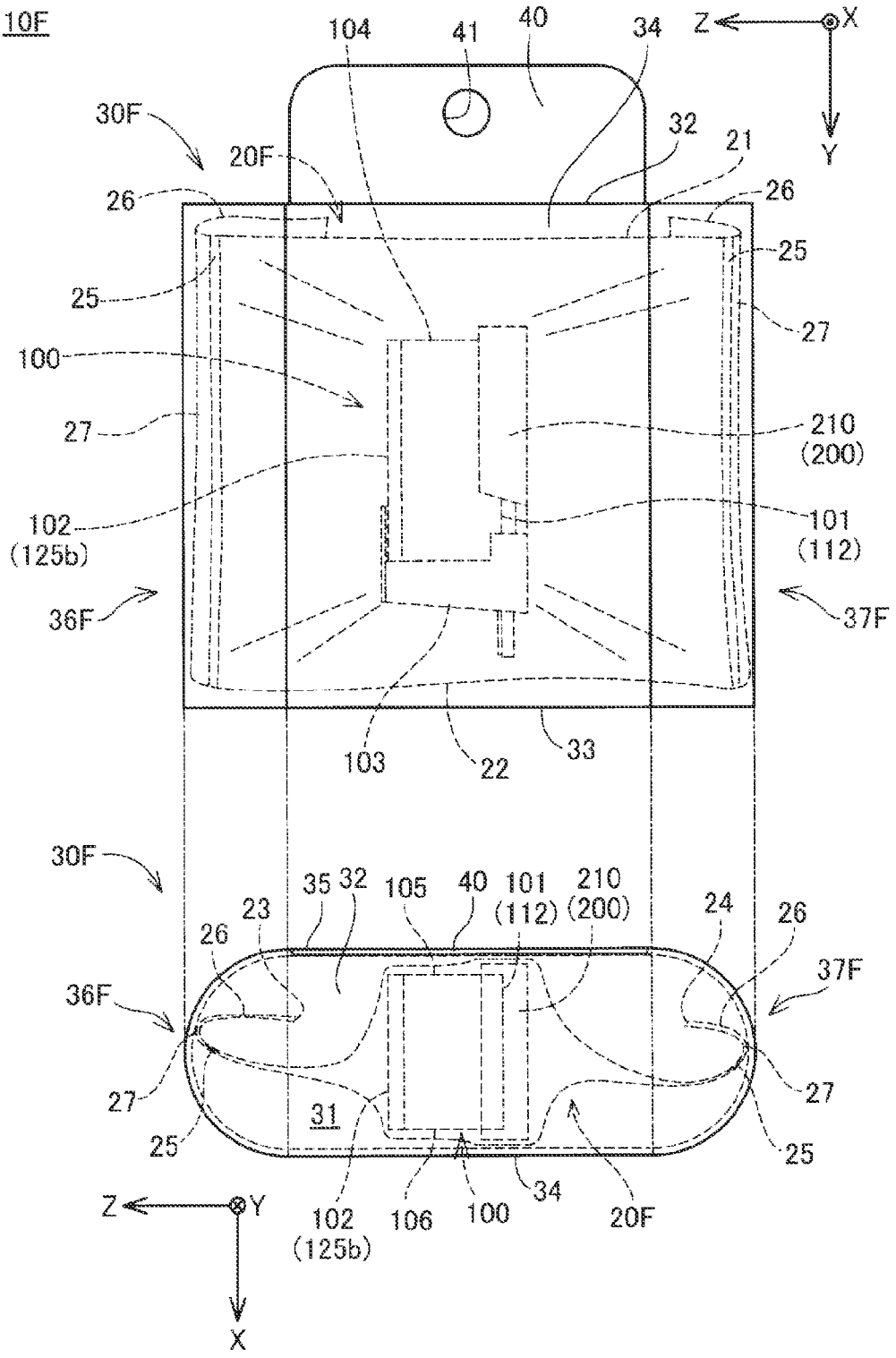
FIG. 16 is a schematic view showing a configuration of a packaging body in a seventh embodiment.

FIG. 16 is a schematic view showing a configuration of a packaging body 10F, which serves as a seventh embodiment of the invention. The upper part of FIG. 16 shows the packaging body 10F in the seventh embodiment as viewed in a direction extending from the front face wall portion 34 toward the back face wall portion 35, and the lower part shows the packaging body 10F in the seventh embodiment as viewed in a direction extending from the upper face wall portion 32 toward the bottom face wall portion 33. In FIG. 16, for the sake of convenience, the cartridge 100 and a bag-shaped member 20F housed in a box-shaped member 30F are indicated by broken lines. The packaging body 10F in the seventh embodiment has roughly the same configuration as that of the packaging body 10 in the first embodiment except the points described below.

In the packaging body 10F in the seventh embodiment, overall wall surfaces of a first side wall portion 36F and a second side wall portion 37F of the box-shaped member 30F each curve in a substantially semicircular shape to constitute a projecting portion that projects outward. The bag-shaped member 20F has the same configuration as that of the bag-shaped member 20C described in the fourth embodiment. The bag-shaped member 20F has sealed portions 25 and bent portions 27 on both the side of the third end side portion 23 and the side of the fourth end side portion 24. The bent portion 27 on the side of the third end side portion 23 of the bag-shaped member 20F corresponds to an end portion arranged between the cartridge 100 and the first side wall portion 36F, and is arranged so as to be able to be locked at an inner wall surface of the first side wall portion 36F. The bent portion 27 on the side of the fourth end side portion 24 corresponds to an end portion arranged between the cartridge 100 and the second side wall portion 37F, and is arranged so as to be able to be locked at an inner wall surface of the second side wall portion 37F.

With the packaging body 10F in the seventh embodiment, an arrangement of the cartridge 100 at an arrangement angle at which the atmosphere introduction hole 125*b* or the ink supply port 112 is oriented vertically downward is suppressed by a projecting structure of the first side wall portion 36F and the second side wall portion 37F. Furthermore, the stability of the arrangement position and the characteristic of protection of the cartridge 100 within the box-shaped member 30F are enhanced by the two bent portions 27 of the bag-shaped member 20F. The packaging body 10F in the seventh embodiment can achieve the same effects as those of the packaging body 10 in the first embodiment.

[H. Eighth Embodiment]

Figure 17:
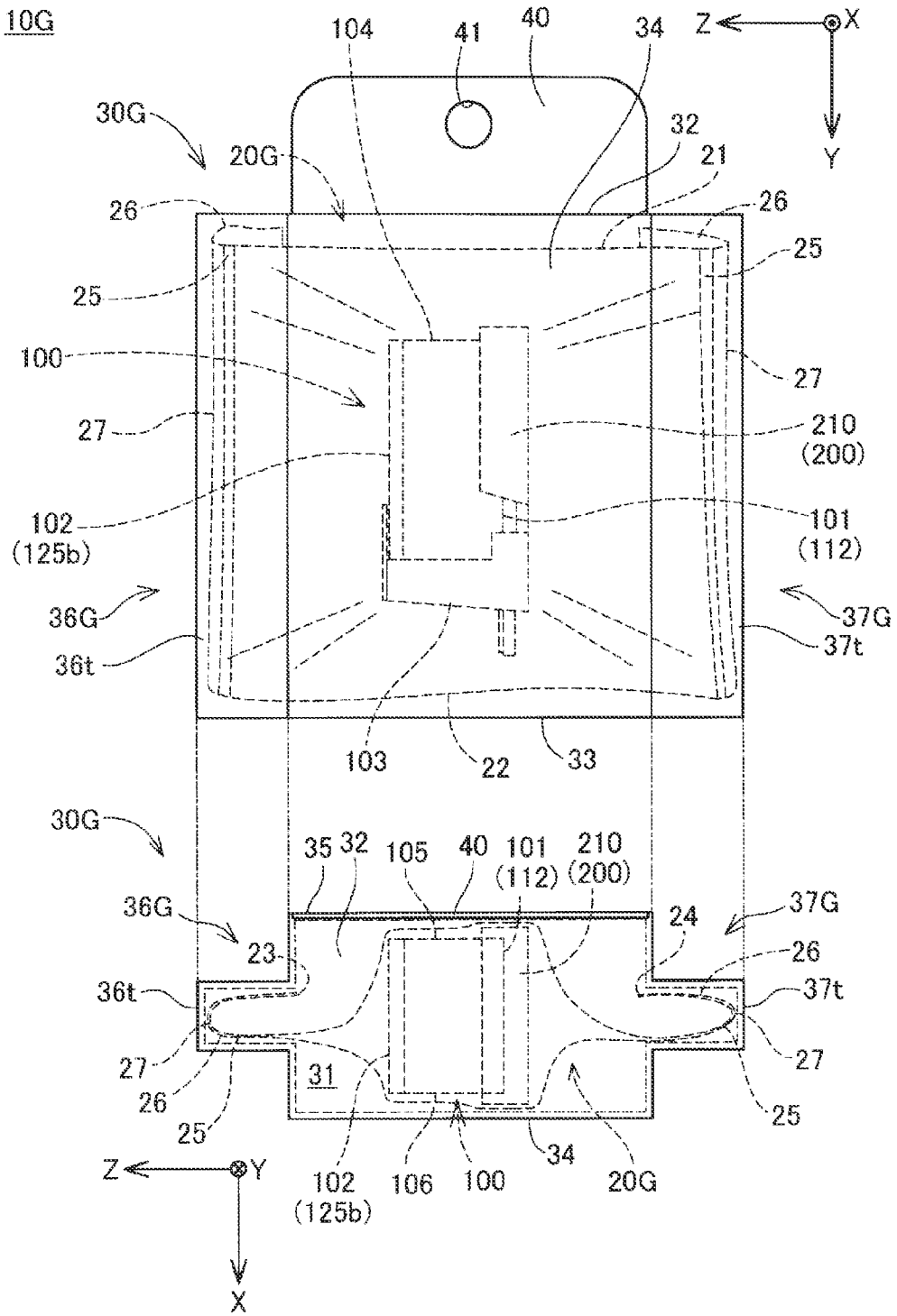
FIG. 17 is a schematic view showing a configuration of a packaging body in an eighth embodiment.

FIG. 17 is a schematic view showing a configuration of a packaging body 10G, which serves as an eighth embodiment of the invention. The upper part of FIG. 17 shows the packaging body 10G in the eighth embodiment as viewed in a direction extending from the front face wall portion 34 toward the back face wall portion 35, and the lower part shows the packaging body 10G in the eighth embodiment as viewed in a direction extending from the upper face wall portion 32 toward the bottom face wall portion 33. In FIG. 17, for the sake of convenience, the cartridge 100 and a bag-shaped member 20G housed in a box-shaped member 30G are indicated by broken lines. The packaging body 10G in the eighth embodiment has roughly the same configuration as that of the packaging body 10 in the first embodiment except the points described below.

In the packaging body 10G in the eighth embodiment, a first side wall portion 36G and a second side wall portion 37G of the box-shaped member 30G respectively have projecting portions 36*t* and 37*t* that locally project. The projecting portions 36*t* and 37*t* are each spanned from the upper face wall portion 32 to the bottom face wall portion 33, and have a substantially rectangular cross-section. It is desirable that the projecting portions 36*t* and 37*t* are each formed to have a narrow width with which the arrangement posture of the packaging body 10G when in a state where the first side wall portion 36G or the second side wall portion 37G are oriented vertically downward is unstable.

The bag-shaped member 20G has the same configuration as that of the bag-shaped member 20F described in the seventh embodiment, and has the sealed portions 25 and the bent portions 27 on both the side of the third end side portion 23 and the side of the fourth end side portion 24. The bent portion 27 on the side of the third end side portion 23 of the bag-shaped member 20G corresponds to an end portion arranged between the cartridge 100 and the first side wall portion 36G, and is housed in a space within the projecting portion 36*t* of the first side wall portion 36G. The bent portion 27 on the side of the fourth end side portion 24 corresponds to an end portion arranged between the cartridge 100 and the second side wall portion 37G, and is housed in a space within the projecting portion 37*t* in the second side wall portion 37G.

With the packaging body 10G in the eighth embodiment, an arrangement of the cartridge 100 at an arrangement angle at which the atmosphere introduction hole 125*b* or the ink supply port 112 is oriented vertically downward is suppressed by the projecting portions 36*t* and 37*t* of the first side wall portion 36G and the second side wall portion 37G. With the packaging body 10G in the eighth embodiment, since the volumes of the inside spaces of the two projecting portions 36*t* and 37*t* are small, the bent portions 27 of the bag-shaped member 20G easily come into contact with inner wall surfaces of the two projecting portions 36*t* and 37*t*, and the characteristics of locking of the bag-shaped member 20G is enhanced. Furthermore, the stability of the arrangement position and the characteristic of protection of the cartridge 100 within the box-shaped member 30G are enhanced by the two bent portions 27 of the bag-shaped member 20G. Additionally, the packaging body 10G in the eighth embodiment can achieve the same effects as those of the packaging body 10 in the first embodiment.

[I. Ninth Embodiment]

Figure 18:
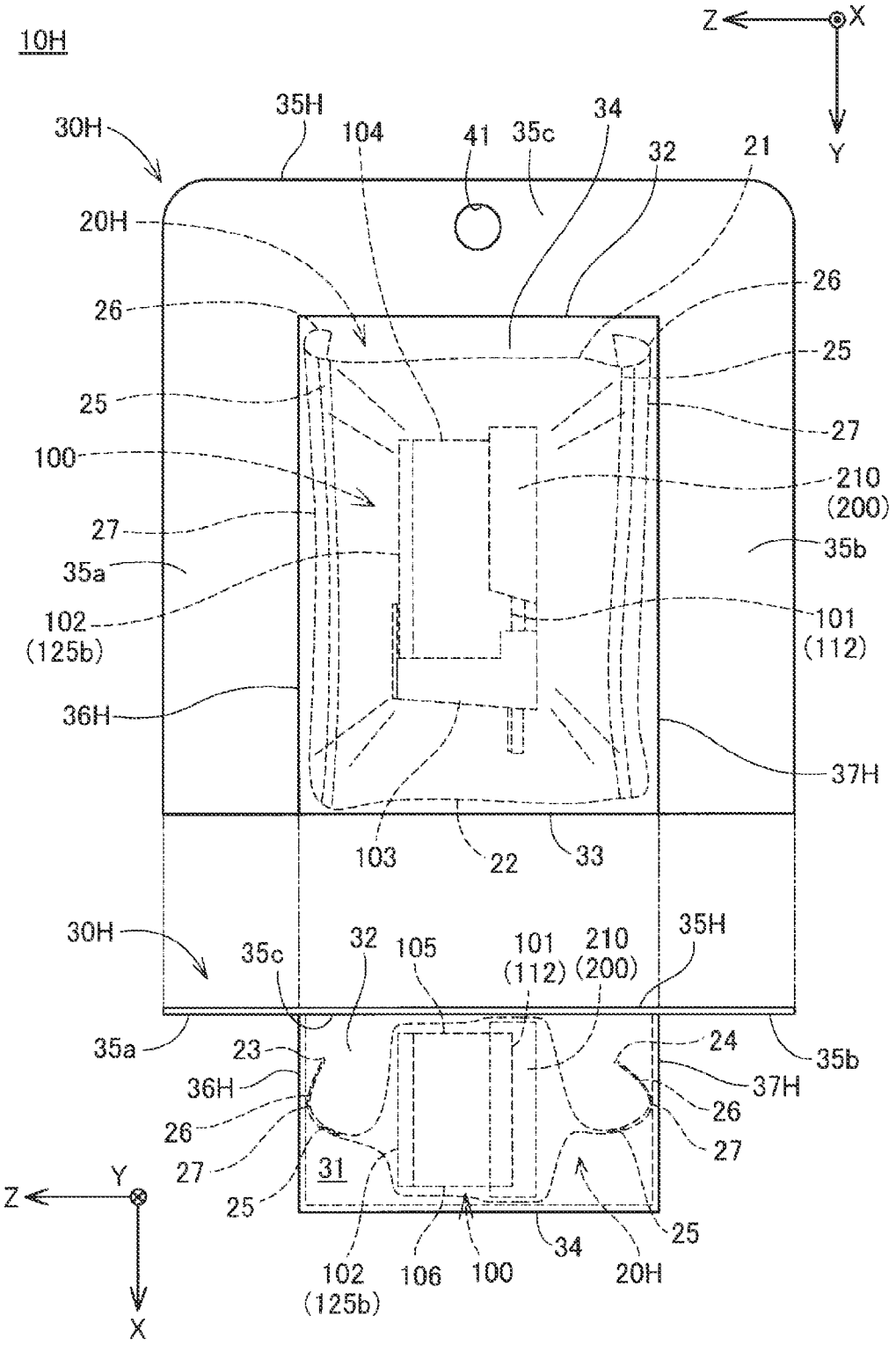
FIG. 18 is a schematic view showing a configuration of a packaging body in a ninth embodiment.

FIG. 18 is a schematic view showing a configuration of a packaging body 10H, which serves as a ninth embodiment of the invention. The upper part of FIG. 18 shows the packaging body 10H in the ninth embodiment as viewed in a direction extending from the front face wall portion 34 toward the back face wall portion 35, and the lower part shows the packaging body 10H in the ninth embodiment as viewed in a direction extending from the upper face wall portion 32 toward the bottom face wall portion 33. In FIG. 18, for the sake of convenience, the cartridge 100 and a bag-shaped member 20H housed in a box-shaped member 30H are indicated by broken lines. The packaging body 10H in the ninth embodiment has roughly the same configuration as that of the packaging body 10 in the first embodiment except the points described below.

In the packaging body 10H in the ninth embodiment, the main body of the box-shaped member 30H has a substantially rectangular parallelepiped shape, and the bag-shaped member 20H that contains the cartridge 100 is housed in the housing space 31 having a substantially rectangular parallelepiped shape. The upper face wall portion 32, the bottom face wall portion 33, the front face wall portion 34, a first side wall portion 36H, and a second side wall portion 37H each have a flat outer wall surface having a substantially rectangular shape. The back face wall portion 35H is constituted by a flat plate-shaped member having a substantially rectangular shape whose area is larger than the area of the front face wall portion 34. The back face wall portion 35H has a first extending portion 35*a* that extends on the side of the first side wall portion 36H, a second extending portion 35*b* that extends on the side of the second side wall portion 37H, and a third extending portion 35*c* that extends on the side of the upper face wall portion 32. The first extending portion 35*a* and the second extending portion 35*b* each correspond to a protruding portion, and the third extending portion 35*c* corresponds to an extending portion that extends outward of the outer wall surface of the upper face wall portion 32.

The packaging body 10H in the ninth embodiment has a configuration in which the first extending portion 35*a* of the back face wall portion 35H further projects than an outer wall surface of the first side wall portion 36H in a direction extending from the atmosphere introduction hole 125*b* toward the first side wall portion 36. Thereby, placement on a horizontal surface with the first side wall portion 36H as a bottom face is suppressed, and an arrangement of the cartridge 100 at an arrangement angle at which the atmosphere introduction hole 125*b* opens vertically downward is suppressed.

The packaging body 10H in the ninth embodiment has a configuration in which the second extending portion 35*b* of the back face wall portion 35H further projects than an outer wall surface of the second side wall portion 37H in a direction extending from the ink supply port 112 toward the second side wall portion 37. Thereby, placement on a horizontal surface with the second side wall portion 37H as a bottom face is suppressed, and an arrangement of the cartridge 100 at an arrangement angle at which the ink supply port 112 opens vertically downward is suppressed. The third extending portion 35*c* of the back face wall portion 35H has the same configuration as that of the extending portion 40 (FIG. 1) of the packaging body 10 in the first embodiment, and achieves the same function as that of the extending portion 40.

In the packaging body 10H in the ninth embodiment, the bag-shaped member 20H has the same configuration as that of the bag-shaped member 20G described in the eighth embodiment. The bent portion 27 on the side of the third end side portion 23 of the bag-shaped member 20G corresponds to an end portion arranged between the cartridge 100 and the first side wall portion 36H, and is arranged so as to be able to be locked at an inner wall surface of the first side wall portion 36H. The bent portion 27 on the side of the fourth end side portion 24 corresponds to an end portion arranged between the cartridge 100 and the second side wall portion 37H, and is arranged so as to be able to be locked at an inner wall surface of the second side wall portion 37H.

As described above, with the packaging body 10H in the ninth embodiment, an arrangement angle of the cartridge 100 is restricted by the three extending portions 35*a* to 35*c* that the back face wall portion 35H has. Additionally, the packaging body 10H in the ninth embodiment can achieve the same effects as those of the packaging body 10 in the first embodiment.

[J. Tenth Embodiment]

Figure 19:
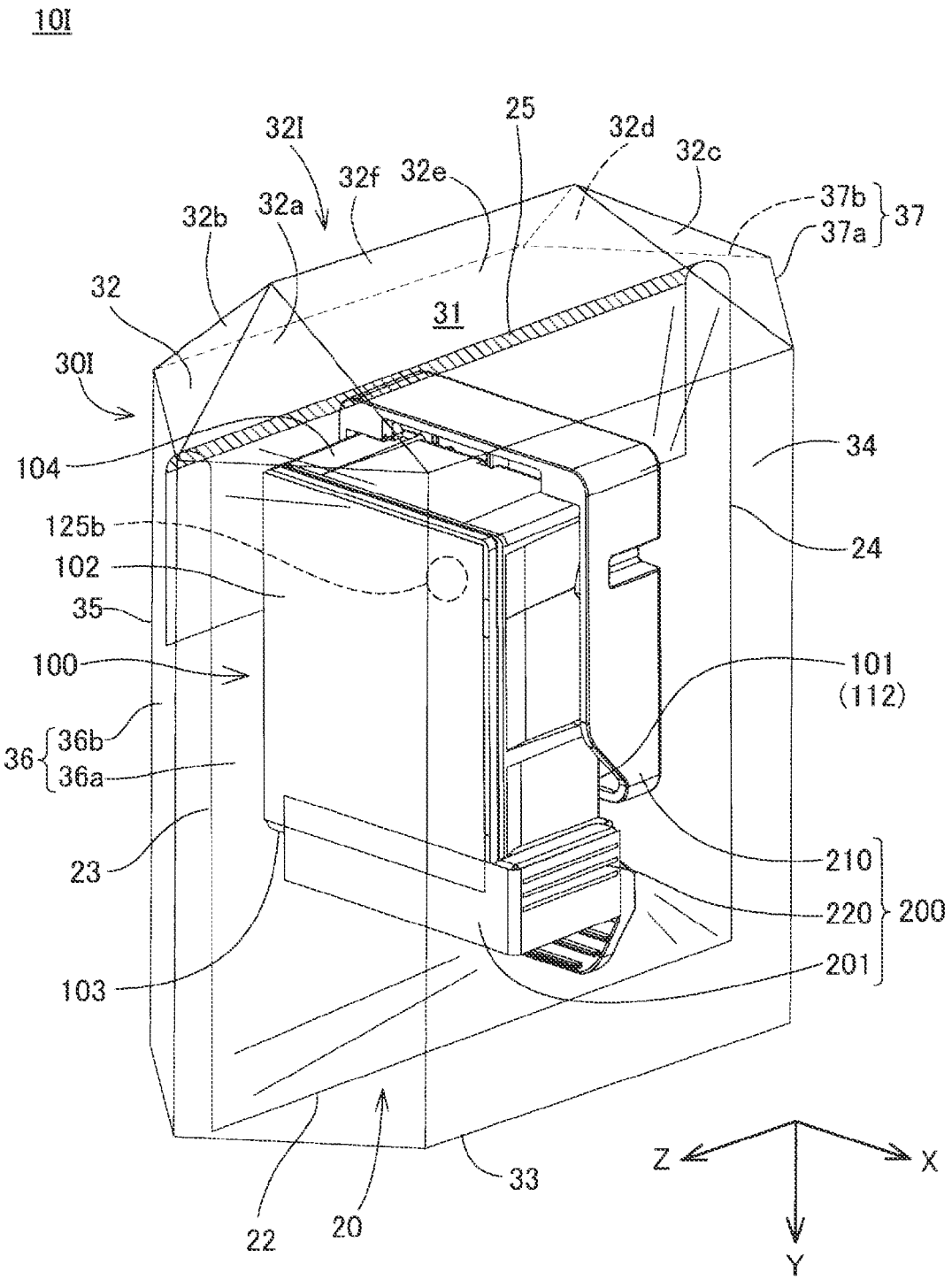
FIG. 19 is a schematic perspective view showing a configuration of a packaging body in a tenth embodiment.

FIG. 19 is a schematic perspective view showing a configuration of a packaging body 10I, which serves as a tenth embodiment of the invention. In FIG. 19, for the sake of convenience, the bag-shaped member 20 and a box-shaped member 30I are shown in a state where the inside thereof is visible. The packaging body 10I in the tenth embodiment has the same configuration as that of the packaging body 10 in the first embodiment except that the packaging body 10I has the box-shaped member 30I whose shape is different.

In the box-shaped member 30I in the tenth embodiment, the extending portion 40 is omitted. An upper face wall portion 32I of the box-shaped member 30I corresponds to an atmosphere introduction hole side wall portion. In the upper face wall portion 32I, a projection portion whose center portion is protruded in a direction extending from the bottom face wall portion 33 toward the upper face wall portion 32I is constituted by a polyhedron having six outer wall surfaces 32*a* to 32*f*.

First and second outer wall surfaces 32*a* and 32*b* of the upper face wall portion 32I each have a substantially triangular shape, and are arranged so as to be adjacent to each other while sharing one side. The first outer wall surface 32*a* of the upper face wall portion 32I intersects the first outer wall surface 36*a* of the first side wall portion 36, and the second outer wall surface 32*b* of the upper face wall portion 32I intersects the second outer wall surface 36*b* of the first side wall portion 36.

Third and fourth outer wall surfaces 32*c* and 32*d* of the upper face wall portion 32I each have a substantially triangular shape, and are arranged so as to be adjacent to each other while sharing one side. The third outer wall surface 32*c* of the upper face wall portion 32I intersects the first outer wall surface 37*a* of the second side wall portion 37, and the fourth outer wall surface 32*d* of the upper face wall portion 32I intersects the second outer wall surface 37*b* of the second side wall portion 37.

Fifth and sixth outer wall surfaces 32*e* and 32*f* of the upper face wall portion 32I each have a substantially rectangular shape, and are arranged so as to be adjacent to each other while sharing one side. The fifth outer wall surface 32*e* of the upper face wall portion 32I is arranged between the first and third outer wall surfaces 32*a* and 32*c*, and intersects the outer wall surface of the front face wall portion 34. The sixth outer wall surface 32*f* of the upper face wall portion 32I is arranged between the second and fourth outer wall surfaces 32*b* and 32*d*, and intersects the outer wall surface of the back face wall portion 35.

With the packaging body 10I in the tenth embodiment of the invention, an arrangement on a horizontal plane with the upper face wall portion 32*i* as a bottom face is suppressed due to the protrusion of the upper face wall portion 32I. Accordingly, an arrangement with which the atmosphere introduction hole 125*b* of the cartridge 100 is located on the lower side in the gravity direction is suppressed, and leakage of the ink into the front face groove portion 126 via the atmosphere introduction hole 125*b* is suppressed. Additionally, the packaging body 10I in the tenth embodiment can achieve the same effects as those of the packaging body 10 in the first embodiment.

[K. Eleventh Embodiment]

Figure 20:
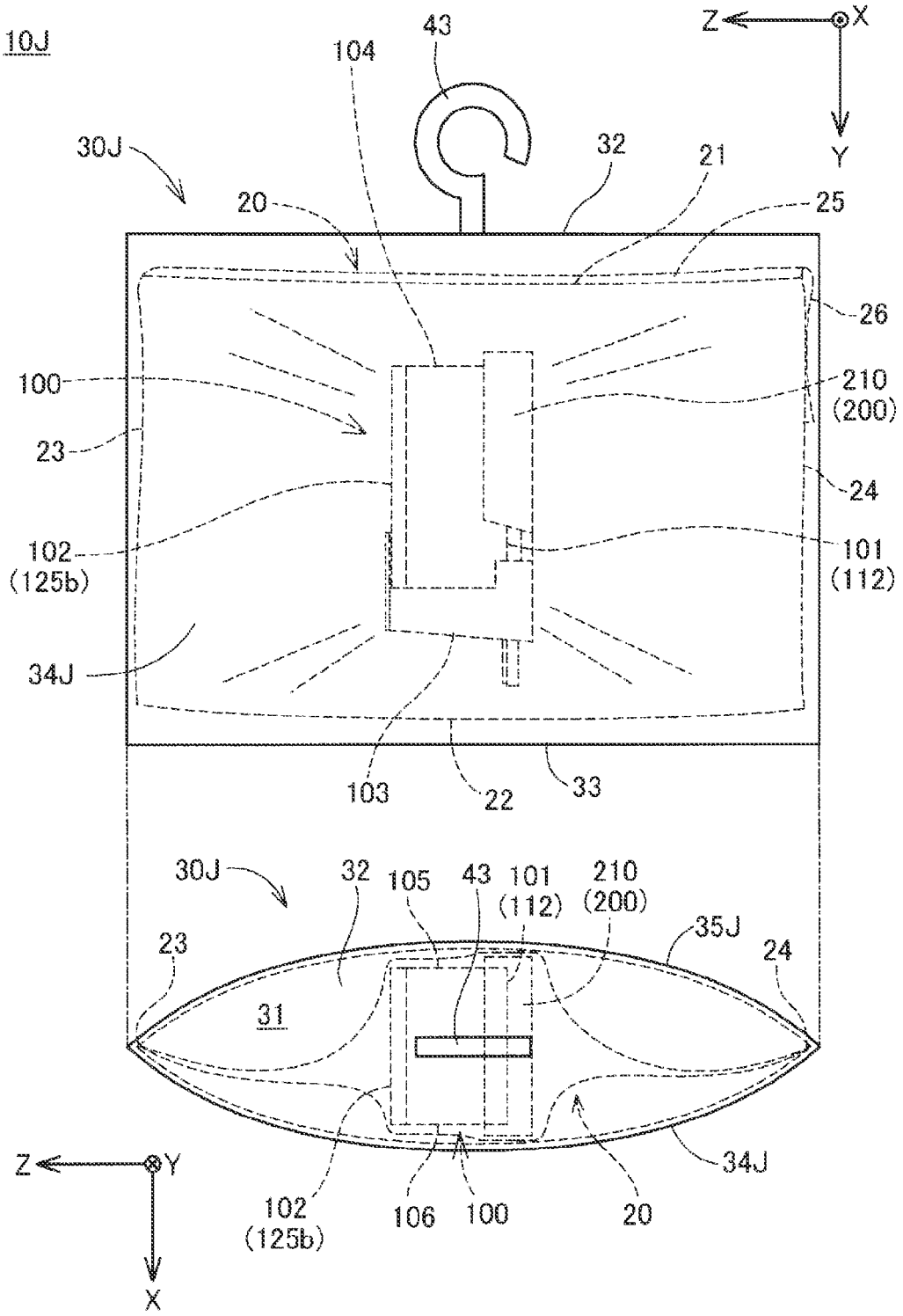
FIG. 20 is a schematic view showing a configuration of a packaging body in an eleventh embodiment.

FIG. 20 is a schematic view showing a configuration of a packaging body 10J, which serves as an eleventh embodiment of the invention. The upper part of FIG. 20 shows the packaging body 10J in the eleventh embodiment as viewed in a direction extending from a front face wall portion 34J toward a back face wall portion 35J, and the lower part shows the packaging body 10J in the eleventh embodiment as viewed in a direction extending from the upper face wall portion 32 toward the bottom face wall portion 33. In FIG. 20, for the sake of convenience, the cartridge 100 and the bag-shaped member 20 housed in a box-shaped member 30J are indicated by broken lines. The packaging body 10J in the eleventh embodiment has roughly the same configuration as that of the packaging body 10 in the first embodiment except that the packaging body 10J has the box-shaped member 30J whose shape is different.

The box-shaped member 30J in the eleventh embodiment has a configuration in which the front face wall portion 34J, which curves outward, and the back face wall portion 35J, which curves outward, are joined to each other at two opposed end portions. The cartridge 100 is arranged between the front face wall portion 34J and the back face wall portion 35J, in a state of being housed in the bag-shaped member 20. The third end side portion 23 and the fourth end side portion 24 of the bag-shaped member 20 are arranged at corner portions at which the front face wall portion 34J and the back face wall portion 35J are joined.

In the box-shaped member 30J in the eleventh embodiment, a wall portion opposed to the atmosphere introduction hole 125*b* of the cartridge 100 and a wall portion opposed to the ink supply port 112 are constituted by end portions of the front face wall portion 34J and the back face wall portion 35J. This configuration can also be interpreted as the end portions that join the front face wall portion 34J and the back face wall portion 35J constituting projecting portions that project in the opening directions of the atmosphere introduction hole 125*b* and the ink supply port 112. With the box-shaped member 30J in the eleventh embodiment, an arrangement of the cartridge 100 at an arrangement angle at which the opening direction of the atmosphere introduction hole 125*b* or the ink supply port 112 is oriented vertically downward is suppressed.

The box-shaped member 30J in the eleventh embodiment is provided with a hook portion 43 above at the center of the upper face wall portion 32. The hook portion 43 corresponds to an extending portion that extends outward of the outer wall surface of the upper face wall portion 32. As a result of provision of the hook portion 43, the packaging body 10J in the eleventh embodiment can be arranged in a state of being hung by locking at the hook portion 43. Furthermore, since the hook portion 43 is provided so as to project upward in the upper face wall portion 32, an arrangement on a horizontal surface with the upper face wall portion 32 as a bottom face is suppressed.

As described above, with the packaging body 10J in the eleventh embodiment, the arrangement angle of the cartridge 100 is restricted by the projecting portion provided in the box-shaped member 30J constituted by the four wall portions 32, 33, 34J, and 35J. Additionally, the packaging body 10J in the eleventh embodiment can achieve the same effects as those of the packaging body 10 in the first embodiment.

[L. Twelfth Embodiment]

Figure 21:
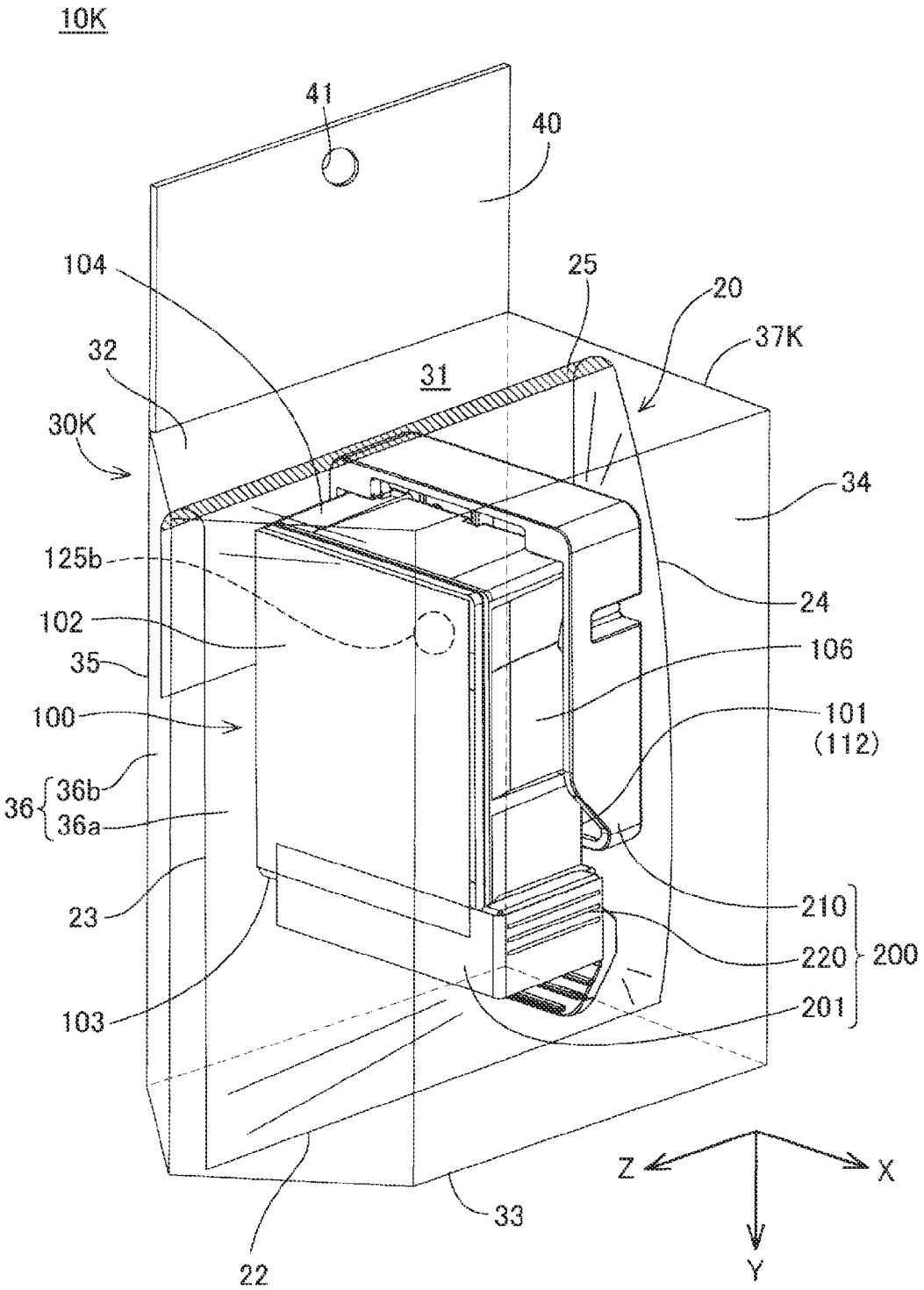
FIG. 21 is a schematic perspective view showing a configuration of a packaging body in a twelfth embodiment.

FIG. 21 is a schematic perspective view showing a configuration of a packaging body 10K, which serves as a twelfth embodiment of the invention. In FIG. 21, for the sake of convenience, the bag-shaped member 20 and a box-shaped member 30K are shown in a state where the inside thereof is visible. The packaging body 10K in the twelfth embodiment has roughly the same configuration as that of the packaging body 10 in the first embodiment except that the projecting portion on the side of the ink supply port 112 is omitted.

In the box-shaped member 30K in the twelfth embodiment, the first side wall portion 36 located at a position opposed to the atmosphere introduction hole 125*b* of the cartridge 100 has the first and second outer wall surfaces 36*a* and 36*b* that constitute the projecting portions, as described in the first embodiment. On the other hand, a second side wall portion 37K located at a position opposed to the ink supply port 112 of the cartridge 100 has a flat outer wall surface arranged roughly parallel with the bottom face 101 of the cartridge 100.

With the packaging body 10K in the twelfth embodiment, an arrangement of the cartridge 100 at an arrangement angle at which the opening direction of the atmosphere introduction hole 125*b* is oriented vertically downward is suppressed by the projecting portion provided in the first side wall portion 36. Accordingly, leakage of the ink into the front face groove portion 126 via the atmosphere introduction hole 125*b* is suppressed. Additionally, the packaging body 10K in the twelfth embodiment can achieve the same effects as those of the packaging body 10 in the first embodiment.

[M. Thirteenth Embodiment]

Figure 22:
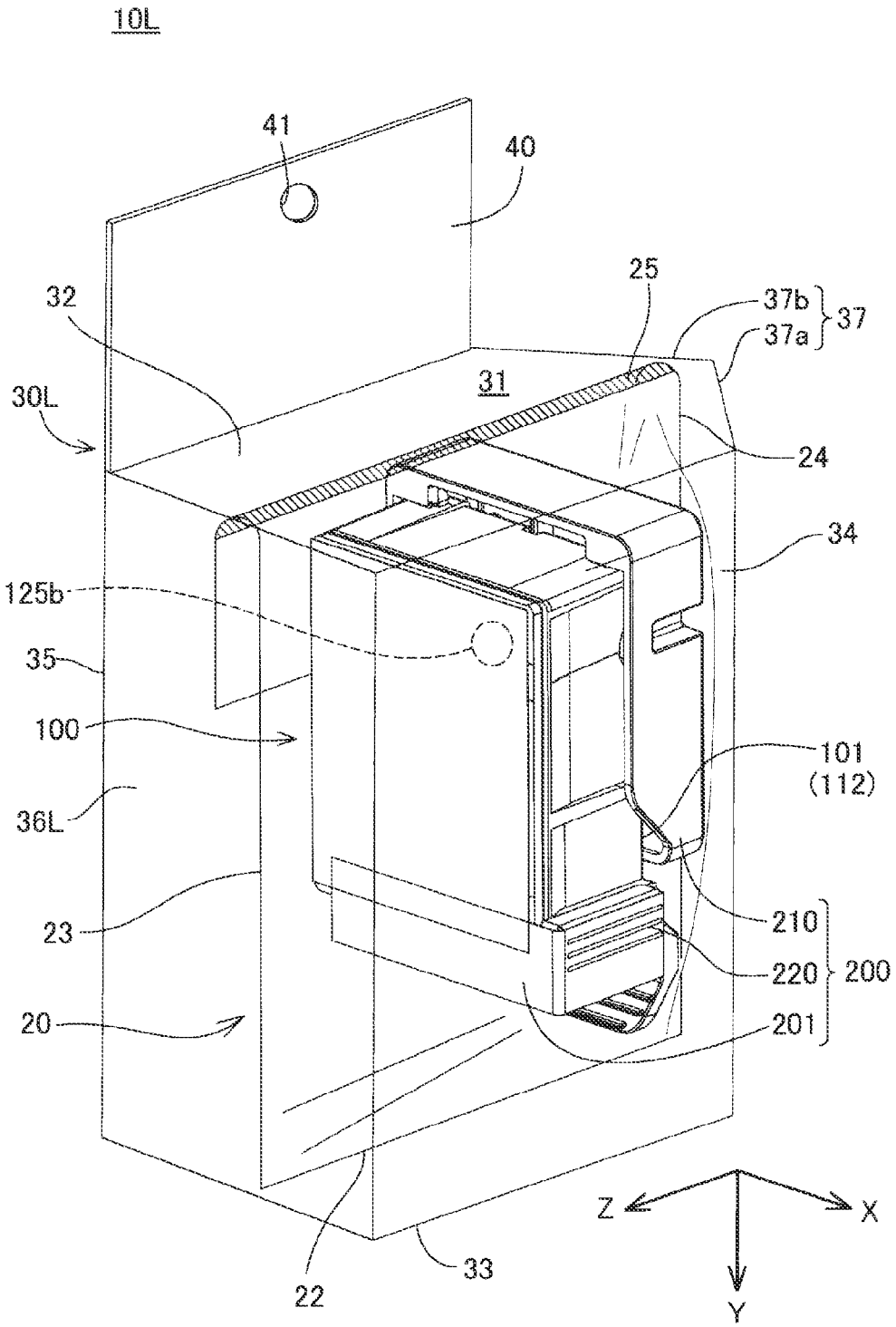
FIG. 22 is a schematic perspective view showing a configuration of a packaging body in a thirteenth embodiment.

FIG. 22 is a schematic perspective view showing a configuration of a packaging body 10L, which serves as a thirteenth embodiment of the invention. In FIG. 22, for the sake of convenience, the bag-shaped member 20 and a box-shaped member 30L are shown in a state where the inside thereof is visible. The packaging body 10L in the thirteenth embodiment has roughly the same configuration as that of the packaging body 10 in the first embodiment except that the projecting portion on the side of the atmosphere introduction hole 125*b* is omitted.

In the box-shaped member 30L in the thirteenth embodiment, the second side wall portion 37 located at a position opposed to the ink supply port 112 of the cartridge 100 has the first and second outer wall surfaces 37*a* and 37*b* that constitute the projecting portion, as described in the first embodiment. On the other hand, a first side wall portion 36L located at a position opposed to the atmosphere introduction hole 125*b* of the cartridge 100 has a flat outer wall surface arranged roughly parallel with the upper face 102 of the cartridge 100.

With the packaging body 10L in the thirteenth embodiment, an arrangement of the cartridge 100 at an arrangement angle at which the opening direction of the ink supply port 112 is oriented vertically downward is suppressed by the projecting portion provided in the second side wall portion 37. Accordingly, occurrence of a concentration distribution in which the concentration of the pigment component on the side of the ink supply port 112 is high in the ink chamber 111 is suppressed. Additionally, the packaging body 10L in the thirteenth embodiment can achieve the same effects as those of the packaging body 10 in the first embodiment.

[N. Fourteenth Embodiment]

Figure 23:
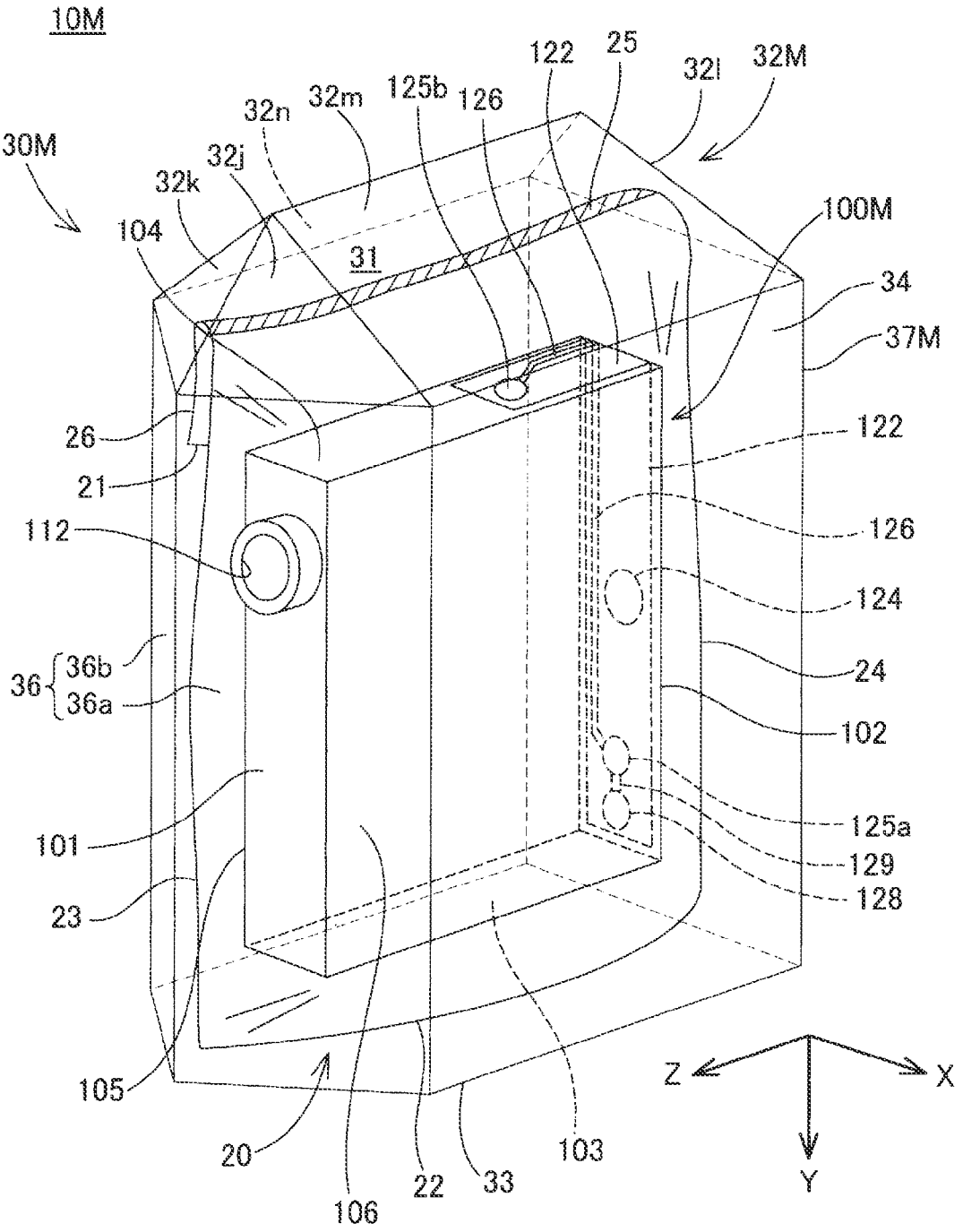
FIG. 23 is a schematic perspective view showing a configuration of a packaging body in a fourteenth embodiment.

FIG. 23 is a schematic perspective view showing a configuration of a packaging body 10M, which serves as a fourteenth embodiment of the invention. In FIG. 23, for the sake of convenience, the bag-shaped member 20 and a box-shaped member 30M are shown in a state where the inside thereof is visible. A cartridge 100M whose configuration is different from that of the cartridge 100 in the above embodiments is housed in the packaging body 10M in the fourteenth embodiment, and the configuration of the box-shaped member 30M has been changed in accordance with the configuration of the cartridge 100M.

The cartridge 100M has a substantially rectangular parallelepiped shape, and has the same six wall surfaces 101 to 106 as those of the cartridge 100 descried in the above embodiments. The ink supply port 112 is provided in the bottom face 101 of the cartridge 100M. The center through hole 124, the atmosphere releasing hole 128, and the atmosphere communication hole 125*a* are provided in the upper face 102. The atmosphere releasing hole 128 and the atmosphere communication hole 125*a* are joined to each other by the back face groove portion 129.

The atmosphere introduction hole 125*b* is provided in the rear face 104. The atmosphere communication hole 125*a* and the atmosphere introduction hole 125*b* are joined to each other by the front face groove portion 126 that extends so as to be spanned from the upper face 102 to the rear face 104. Opening portions of the center through hole 124, the atmosphere communication hole 125*a*, the atmosphere introduction hole 125*b*, and the front face groove portion 126 are sealed by a seal member 122 arranged so as to be spanned from the upper face 102 to the rear face 104.

The cartridge 100M contains pigment ink and an ink holding member in an inner ink chamber (not shown; a detailed description thereof will be omitted), as the cartridge 100 in the above embodiments does. The cartridge 100M may further be provided with a circuit board for electrical connection to the printer, an engaging mechanism for installation in the carriage, and the like.

In the packaging body 10M in the fourteenth embodiment, the cartridge 100M is housed in the bag-shaped member 20 having the same configuration as that described in the first embodiment. The cartridge 100M is housed in the bag-shaped member 20 such that the front face 103 of the cartridge 100M faces the second end side portion 22 of the bag-shaped member 20, the bottom face 101 faces the third end side portion 23, and the upper face 102 faces the fourth end side portion 24. The rear face 104 of the cartridge 100M faces the sealed portion 25 of the bag-shaped member 20. Note that a protection member capable of sealing the ink supply port 112 may be attached to the cartridge 100M when being housed in the bag-shaped member 20.

The box-shaped member 30M has an upper face wall portion 32M, the bottom face wall portion 33, the front face wall portion 34, the back face wall portion 35, the first side wall portion 36, and a second side wall portion 37M as wall portions surrounding the housing space 31. The first side wall portion 36 has the first and second outer wall surfaces 36*a* and 36*b* that constitute a projecting portion, as described in the first embodiment.

The second side wall portion 37M has a flat outer wall surface that is located at a position opposed to the first side wall portion 36 and has a substantially rectangular shape. The front face wall portion 34 and the back face wall portion 35 have rectangular shapes of roughly the same size, and are arranged parallel with each other. The front face wall portion 34 intersects the first outer wall surface 36*a* of the first side wall portion 36 and an outer wall surface of the second side wall portion 37M, and the back face wall portion 35 intersects the second outer wall surface 36*b* of the first side wall portion 36 and the outer wall surface of the second side wall portion 37M. The bottom face wall portion 33 has a flat wall surface that intersects the front face wall portion 34, the back face wall portion 35, the first side wall portion 36, and the second side wall portion 37M.

The upper face wall portion 32M is located at a position opposed to the bottom face wall portion 33, and has five outer wall surfaces 32*j* to 32*n*. In the upper face wall portion 32M, a projecting portion that projects in a direction extending from the bottom face wall portion 33 toward the upper face wall portion 32M is constituted by the five outer wall surfaces 32*j* to 32*n*. First and second outer wall surfaces 32*j* and 32*k* of the upper face wall portion 32M each have a substantially triangular shape, and are arranged so as to be adjacent to each other while sharing one side. The first outer wall surface 32*j* intersects the first outer wall surface 36*a* of the first side wall portion 36, and the second outer wall surface 32*k* intersects the second outer wall surface 36*b* of the first side wall portion 36.

A third outer wall surface 32*l* has a substantially triangular shape, and intersects the outer wall surface of the second side wall portion 37M. Fourth and fifth outer wall surfaces 32*m* and 32*n* each have a substantially rectangular shape, and are arranged so as to be adjacent to each other while sharing one side. The fourth outer wall surface 32*m* is arranged between the first and third outer wall surfaces 32*j* and 32*l*, and intersects the outer wall surface of the front face wall portion 34. The fifth outer wall surface 32*n* is arranged between the second and third outer wall surfaces 32*k* and 32*l*, and intersects the outer wall surface of the back face wall portion 35.

The bag-shaped member 20 that houses the cartridge 100M is arranged within the box-shaped member 30M in the following manner. The bag-shaped member 20 is arranged such that the sealed portion 25 faces the upper face wall portion 32M, the second end side portion 22 faces the bottom face wall portion 33, the third end side portion 23 faces the first side wall portion 36, and the fourth end side portion 24 faces the second side wall portion 37M. The sealed portion 25 of the bag-shaped member 20 corresponds to a bent portion of the bag-shaped member 20, and also corresponds to an end portion housed in a space surrounded by an inner wall surface of the upper face wall portion 32M. The third end side portion 23 of the bag-shaped member 20 corresponds to an end portion housed at a corner portion between the first and second outer wall surfaces 36*a* and 36*b* of the first side wall portion 36.

With the packaging body 10M in the fourteenth embodiment, an arrangement of the cartridge 100M at an arrangement angle at which the opening direction of the atmosphere introduction hole 125*b* or the ink supply port 112 is oriented vertically downward is suppressed by the projecting portions provided in the upper face wall portion 32M and the first side wall portion 36. Furthermore, a change of the arrangement position and the arrangement angle of the cartridge 100M within the box-shaped member 30M is suppressed by the end portion of the bag-shaped member 20. Additionally, the packaging body 10M in the fourteenth embodiment can achieve the same effects as those of the packaging body 10 in the first embodiment.

O. Fifteenth Embodiment

Figure 24:
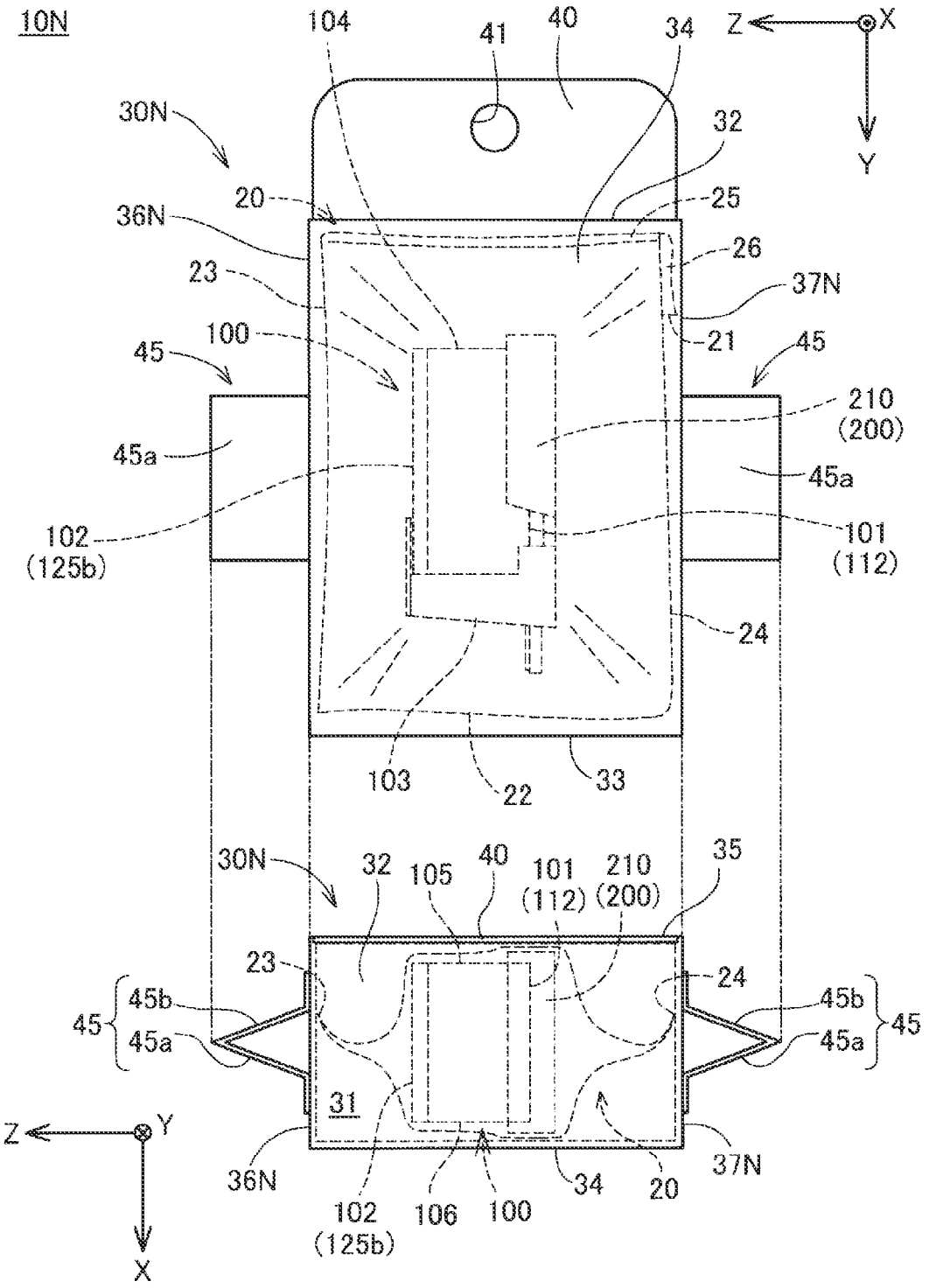
FIG. 24 is a schematic view showing a configuration of a packaging body in a fifteenth embodiment.

FIG. 24 is a schematic view showing a configuration of a packaging body 10N, which serves as a fifteenth embodiment of the invention. The upper part of FIG. 24 shows the packaging body 10N in the fifteenth embodiment as viewed in a direction extending from the front face wall portion 34 toward the back face wall portion 35, and the lower part shows the packaging body 10N in the fifteenth embodiment as viewed in a direction extending from the upper face wall portion 32 toward the bottom face wall portion 33. In FIG. 24, for the sake of convenience, the cartridge 100 and the bag-shaped member 20 housed in a box-shaped member 30N are indicated by broken lines. The packaging body 10N in the fifteenth embodiment has roughly the same configuration as that of the packaging body 10 in the first embodiment except that the packaging body 10N has the box-shaped member 30N whose configuration is different.

In the packaging body 10N in the fifteenth embodiment, the main body of the box-shaped member 30N has a substantially rectangular parallelepiped shape, and the bag-shaped member 20 that contains the cartridge 100 is housed in the housing space 31 having a substantially rectangular parallelepiped shape. The bag-shaped member 20 is arranged in the box-shaped member 30N such that the third end side portion 23 almost comes into contact with an inner wall surface of a first side wall portion 36N of the box-shaped member 30N, and the fourth end side portion 24 almost comes into contact with an inner wall surface of a second side wall portion 37N of the box-shaped member 30N.

A protrusion member 45 is attached to each of center portions of the first side wall portion 36N and the second side wall portion 37N of the box-shaped member 30N. Each protrusion member 45 has two flat wall portions 45*a* and 45*b* that intersect each other. The first wall portion 45*a* is arranged on the side of the front face wall portion 34, and the second wall portion 45*b* is arranged on the side of the back face wall portion 35. A corner portion between the first and second wall portions 45*a* and 45*b* constitutes an apex of the protrusion member 45.

With the packaging body 10N in the fifteenth embodiment, an arrangement of the cartridge 100 at an arrangement angle at which the atmosphere introduction hole 125*b* or the ink supply port 112 is oriented vertically downward is suppressed by the protrusion members 45 attached to the first side wall portion 36 and the second side wall portion 37. Additionally, the packaging body 10N in the fifteenth embodiment can achieve the same effects as those of the packaging body 10 in the first embodiment.

[P. Sixteenth Embodiment]

Figure 25:
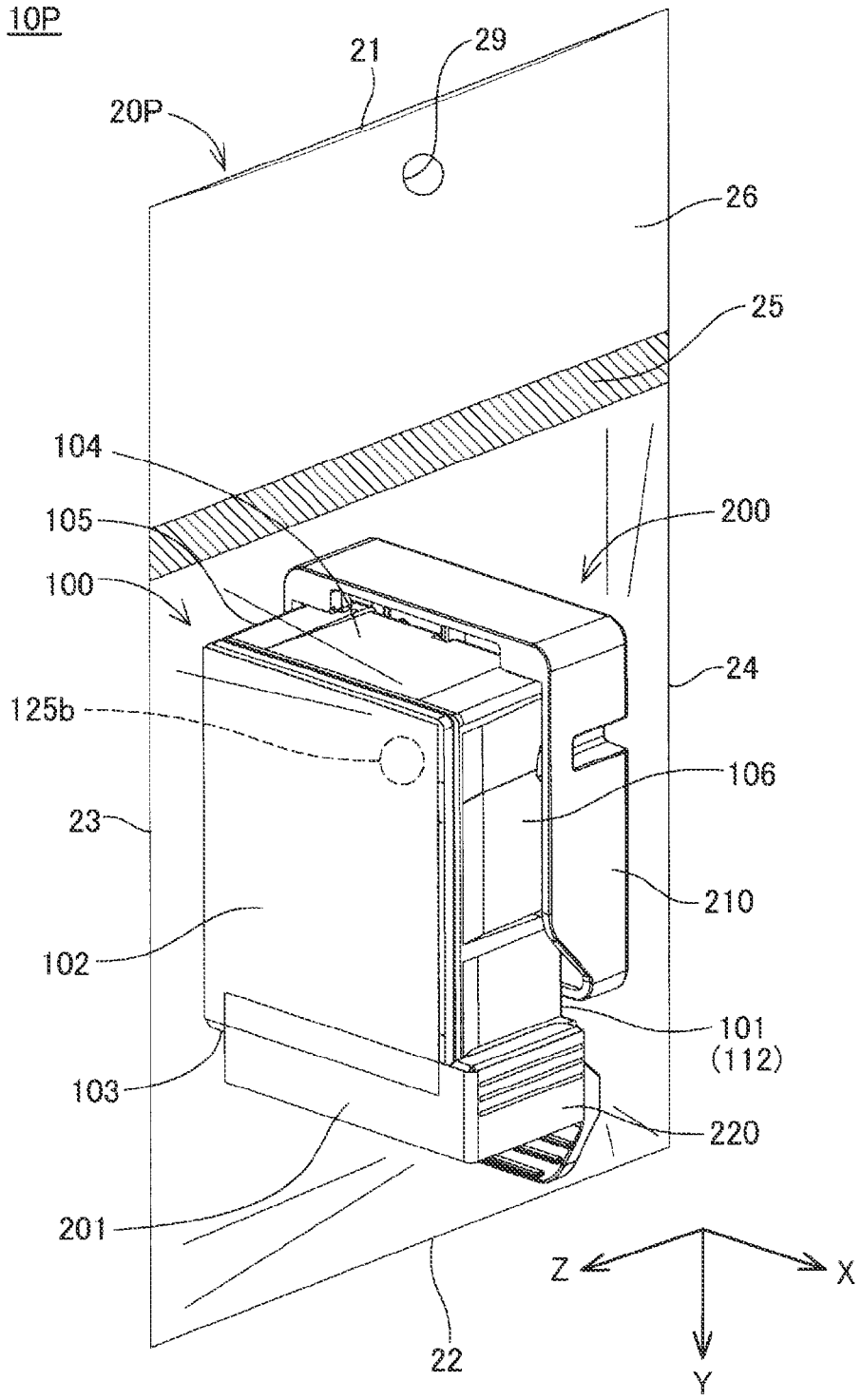
FIG. 25 is a schematic perspective view showing a configuration of a packaging body in a sixteenth embodiment.

FIG. 25 is a schematic perspective view showing a configuration of a packaging body 10P, which serves as a sixteenth embodiment of the invention. In FIG. 25, for the sake of convenience, a bag-shaped member 20P is shown in a state where the inside thereof is visible. The packaging body 10P in the sixteenth embodiment corresponds to a configuration in which the box-shaped member 30 is omitted in the packaging body 10 in the first embodiment.

The bag-shaped member 20P in the sixteenth embodiment has roughly the same configuration as that of the bag-shaped member 20 described in the first embodiment. The cartridge 100 is housed in the bag-shaped member 20P such that the bottom face 101 faces the fourth end side portion 24, the upper face 102 faces the third end side portion 23, the front face 103 faces the second end side portion 22, and the rear face 104 faces the first end side portion 21 with the sealed portion 25 therebetween. Note that the extension portion 26 between the first end side portion 21 and the sealed portion 25 of the bag-shaped member 20P is provided with a through hole 29 for hanging the packaging body 10P at a hook or the like in a locked manner.

In the packaging body 10P in the sixteenth embodiment, pleat-like end portions of the bag-shaped member 20P exist at a position opposed to the upper face 102 of the cartridge 100 and a position opposed to the bottom face 101 thereof. For this reason, an arrangement of the packaging body 10P in the sixteenth embodiment with the upper face 102 or the bottom face 101 of the cartridge 100 as a bottom face is suppressed. Accordingly, leakage of the ink into the front face groove portion 126 via the atmosphere introduction hole 125*b* and occurrence of a concentration distribution in which the concentration of the pigment component is higher on the side of the ink supply port 112 are suppressed. Additionally, the packaging body 10P in the sixteenth embodiment can achieve a reduction in the size and the weight thereof and reduce production costs thereof since an exterior member for housing the bag-shaped member 20P is not provided.

Q. Modifications:

Q1. Modification 1:

In the above embodiments, the cartridges 100 and 100M contain pigment ink. In this regard, the cartridges 100 and 100M may not contain pigment ink, and may contain dye ink, for example. In the case of a cartridge containing dye ink, it should be noted that the ink holding member in the cartridge may be omitted. The cartridges 100 and 100M may contain ink that contains a dispersoid component other than the pigment component. Examples of the dispersoid component other than the pigment component include metal powder used in metallic ink, for example.

Q2. Modification 2:

The bag-shaped members 20, 20B, 20C, 20F, 20G, 20H, and 20P in the above embodiments have a substantially rectangular shape. In this regard, the bag-shaped members 20, 20B, 20C, 20F, 20G, 20H, and 20P may have a shape other than the substantially rectangular shape. For example, the bag-shaped members 20, 20B, 20C, 20F, 20G, 20H, and 20P may have a polygonal shape other than the substantially rectangular shape, or may have a substantially ellipse shape.

Q3. Modification 3:

The end side portions 22 to 24 of the bag-shaped member 20 in the above first embodiment are each configured as an adhered portion formed by adhering sheet-shaped members to each other. In this regard, the end side portions 22 to 24 each may not be configured as an adhered portion, and may be configured by a bent portion formed by bending a sheet-shaped member, for example.

Q4. Modification 4:

In the above embodiments, the bag-shaped members 20, 20B, 20C, 20F, 20G, 20H, and 20P that are the housing members of the cartridges 100 and 100M are each constituted by a flexible sheet-shaped resin member. In this regard, the housing members of the cartridges 100 and 100M each may not be constituted by a flexible sheet-shaped resin member. The housing members of the cartridges 100 and 100M each may be constituted by a packaging member formed by adhering plastic sheet-shaped members whose shape is fixed to each other, for example.

Q5. Modification 5:

In the packaging bodies 10 and 10A to 10N in the above embodiments, the bag-shaped members 20, 20B, 20C, 20F, 20G, and 20H that house the cartridges 100 and 100M are each in a state of being covered with the box-shaped members 30 and 30E to 30M that are the exterior members. In this regard, the bag-shaped members 20, 20B, 20C, 20F, 20G, and 20H that house the cartridges 100 and 100M each may not be in a state of being completely covered. Wall portions of the box-shaped members 30 and 30E to 30M each may be provided with an opening portion such as a through hole or a window portion, and some of the wall portions may be omitted.

Q6. Modification 6:

Although the box-shaped members 30, 30D, 30E, 30F, 30G, 30H, 30K, 30L, and 30N in the above embodiments are each provided with the extending portion 40 or the third extending portion 35*c*, the extending portion 40 and the third extending portion 35*c* may be omitted. The bottom face wall portions 33 of the box-shaped members 30, 30A, and 30D to 30N in the above embodiments each have a flat wall surface. In this regard, each bottom face wall portion 33 may not have a flat wall surface, and may have a curved surface or may have a protruding portion, for example.

Q7. Modification 7:

In the ninth embodiment, the back face wall portion 35H of the box-shaped member 30H has the first extending portion 35*a* and the second extending portion 35*b*. In this regard, one of the first extending portion 35*a* and the second extending portion 35*b* may be omitted. For example, in order to suppress an arrangement of the cartridge 100 at an arrangement angle at which the opening direction of the ink supply port 112 is oriented vertically downward, only the second extending portion 35*b* may be provided in the back face wall portion 35H of the box-shaped member 30H. In order to suppress an arrangement of the cartridge 100 at an arrangement angle at which the opening direction of the atmosphere introduction hole 125*b* is oriented vertically downward, only the first extending portion 35*a* may be provided in the back face wall portion 35H in the box-shaped member 30H. In the ninth embodiment, the first extending portion 35*a* and the second extending portion 35*b* of the box-shaped member 30H each may not be constituted by a flat plate-shaped member, and may be constituted by a bar-shaped member, for example.

Q8. Modification 8:

In the packaging body 10H in the ninth embodiment, the back face wall portion 35H of the box-shaped member 30H has the first extending portion 35*a* and the second extending portion 35*b* that extend so as to further project than the outer wall surfaces of the first side wall portion 36H and the second side wall portion 37H, respectively. In this regard, the first extending portion 35*a* and the second extending portion 35*b* may be provided in a wall portion other than the back face wall portion 35H. For example, the first extending portion 35*a* and the second extending portion 35*b* may be formed by extending the upper face wall portion 32 or the bottom face wall portion 33. Furthermore, the first extending portion 35*a* and the second extending portion 35*b* may be formed so as to extend from an outer wall surface of the first side wall portion 36H or the second side wall portion 37H. The first extending portion 35*a* and the second extending portion 35*b* may be bent in the middle.

Q9. Modification 9:

In the fifteenth embodiment, the protrusion members 45 each have a configuration in which the first and second wall portions 45*a* and 45*b* intersect each other. The protrusion members 45 are not limited to the above configuration in which the first and second wall portions 45*a* and 45*b* are provided, and may have other configurations. For example, the protrusion members 45 may be constituted by plate-shaped members or wire members that are curved in the opening directions of the atmosphere introduction hole 125*b* and the ink supply port 112, respectively.

Q10. Modification 10:

In the sixteenth embodiment, the bag-shaped member 20P has the third end side portion 23 on the side in the opening direction of the atmosphere introduction hole 125*b*, and has the fourth end side portion 24 on the side in the opening direction of the ink supply port 112. In this regard, one of the third end side portion 23 and the fourth end side portion 24 may be omitted. For example, the bag-shaped member 20P may be configured to be flat on the side in the opening direction of the atmosphere introduction hole 125*b*, or conversely, the bag-shaped member 20P may be configured to be flat on the side in the opening direction of the ink supply port 112.

Q11. Modification 11:

The cartridges 100 and 100M in the above embodiments have a substantially rectangular parallelepiped shape, and each have six wall portions 101 to 106. In this regard, the cartridges 100 and 100M may not have a substantially rectangular parallelepiped shape, and may not have all of the six wall portions 101 to 106. The cartridges 100 and 100M may be configured to be a polyhedron having a substantially trapezoidal shape or a substantially triangular shape as viewed in the arrow X direction, or may be configured to have a substantially disk body having a substantially ellipse shape as viewed in the arrow X direction, for example. The wall portions 101 to 106 constituting the outer shapes of the cartridges 100 and 100M each may not have a flat surface or a smooth surface, and may have recesses and projections. The wall portions 101 to 106 each may not be present so as to extend in a substantially flat shape, and may have a cut or a slit. The wall portions 101 to 106 each may be bent in a substantially curved surface shape.

Q12. Modification 12:

The cartridges 100 and 100M to be used in a printer are housed in the packaging bodies 10, 10A to 10N, and 10P in the above embodiments. In this regard, liquid cartridges other than the cartridges to be used in a printer may be housed in the packaging bodies 10, 10A to 10N, and 10P in the above embodiments. A liquid cartridge is a liquid container body configured to be able to supply liquid to the outside. The liquid in the liquid cartridge may contain a dispersoid component, or may not contain a dispersoid component.

Q13. Modification 13

The configurations of the packaging bodies 10, 10A to 10N, and 10P in the above embodiments can be combined as appropriate. For example, a packaging body including a box-shaped member that includes the first side wall portion 36 having the first and second outer wall surfaces 36*a* and 36*b* in the first embodiment and the second side wall portion 37D having the second inclined outer wall surface 37*s* in the fifth embodiment may be configured. The bag-shaped members 20B and 20C described respectively in the third embodiment and the fourth embodiment may be combined with the box-shaped members 30D, 30E, and 30I to 30N described respectively in the fifth embodiment, the sixth embodiment, and the tenth to fifteenth embodiments. Conversely, the bag-shaped member 20 described in the first embodiment may be combined with the box-shaped members 30F, 30G, and 30H described respectively in the seventh to ninth embodiments. The bag-shaped member 20P described in the sixteenth embodiment may be configured similarly to the bag-shaped members 20B and 20C described respectively in the third embodiment and the fourth embodiment.

The invention is not limited to the above embodiment, examples, and modifications, and can be achieved by various configurations without departing from the gist thereof. For example, the technical features in the embodiments, the examples, and the modifications corresponding to the technical features in each mode described in the summary of the invention can be replaced or combined as appropriate in order to solve a part of or all of the foregoing problem, or in order to achieve some or all of the aforementioned effects. A technical feature that is not described as essential in the specification can be deleted as appropriate.

What is claimed is:

1. A liquid container comprising:

a liquid cartridge that contains liquid;

a housing member that is constituted by a sheet-shaped member and houses the liquid cartridge; and a box-shaped exterior member that houses the liquid cartridge housed in the housing member, wherein the liquid cartridge has an atmosphere introduction hole with which an atmosphere is configured to be introduced to an inside of the liquid cartridge, the exterior member has at least a wall portion located at a position opposed to the atmosphere introduction hole, the wall portion has a projecting portion that projects in a direction extending from the atmosphere introduction hole toward the wall portion, and the housing member has an end portion located between the wall portion and the liquid cartridge.

2. The liquid container according to claim 1, wherein the end portion of the housing member is housed in a space formed within the projecting portion.

3. The liquid container according to claim 1, wherein the projecting portion is formed by projecting a surface of the wall portion, and has two or more flat surfaces inclining with respect to a direction extending from the atmosphere introduction hole toward the wall portion, and when at least one of the flat surfaces of the projecting portion is oriented vertically downward, the center of gravity of the exterior member is located at a position that is out of the flat surface as viewed in a direction parallel with a vertical direction.

4. The liquid container according to claim 1, wherein the projecting portion is constituted by a curved surface formed by projecting a surface of the wall portion.

5. The liquid container according to claim 1, wherein the housing member has a bent portion that is bent between the wall portion and the liquid cartridge.

6. The liquid container according to claim 1, wherein the liquid contains a dispersoid component, the liquid cartridge houses a liquid holding member configured to hold the liquid, and has a liquid supply port with which the liquid is configured to be supplied to the outside, the exterior member has, in addition to a first wall portion that is the wall portion, a second wall portion located at a position opposed to the liquid supply port when the liquid cartridge is housed, and has, in addition to a first projecting portion that is the projecting portion, a second projecting portion that projects in a direction extending from the liquid supply port toward the second wall portion, and the housing member has, in addition to a first end portion that is the end portion, a second end portion located between the second wall portion and the liquid cartridge.

7. The liquid container according to claim 1, wherein the atmosphere introduction hole is formed at a position close to an end portion of the liquid cartridge, the exterior member has an atmosphere introduction hole side wall portion that is arranged at a position adjacent to the end portion of the liquid cartridge and intersects the wall portion, and the atmosphere introduction hole side wall portion has a projection portion that projects in a direction extending from the atmosphere introduction hole toward the end portion of the liquid cartridge.

8. The liquid container according to claim 1, wherein the atmosphere introduction hole is formed at a position close to an end portion of the liquid cartridge, the exterior member has an atmosphere introduction hole side wall portion that is arranged at a position adjacent to the end portion of the liquid cartridge and intersects the wall portion, and the exterior member has an extending portion that further extends than an outer wall surface of the atmosphere introduction hole side wall portion in a direction extending from the atmosphere introduction hole toward the end portion of the liquid cartridge.

9. The liquid container according to claim 1, wherein the atmosphere introduction hole is formed at a position close to an end portion of the liquid cartridge, the exterior member has an atmosphere introduction hole-separate wall portion that is arranged in a direction opposite to a direction extending from the atmosphere introduction hole toward the end portion of the liquid cartridge and intersects the wall portion, and the atmosphere introduction hole-separate wall portion has a flat wall surface parallel with a direction extending from the atmosphere introduction hole toward the wall portion.

10. The liquid container according to claim 6, wherein the liquid cartridge is equipped with a cover member that covers the liquid supply port.

11. The liquid container according to claim 1, wherein the end portion is an adhered portion formed by adhering end portions of the sheet-shaped member to each other.

12. A liquid container comprising:

a liquid cartridge that contains liquid;

a housing member that is constituted by a sheet-shaped member and houses the liquid cartridge; and a box-shaped exterior member that houses the liquid cartridge housed in the housing member, wherein the liquid cartridge has an atmosphere introduction hole with which an atmosphere can be introduced to an inside of the liquid cartridge, the exterior member has at least a wall portion located at a position opposed to the atmosphere introduction hole, an outer wall surface of the wall portion is constituted by one or more flat surfaces inclining with respect to a direction extending from the atmosphere introduction hole toward the wall portion, and the housing member has an end portion located between the wall portion and the liquid cartridge.

13. The liquid container according to claim 12,
wherein when at least one of the flat surfaces constituting the outer wall surface of the wall portion is oriented vertically downward, the center of gravity of the exterior member is located at a position that is out of the flat surface as viewed in a direction parallel with a vertical direction.

14. The liquid container according to claim 12,
wherein the liquid contains a dispersoid component,
the liquid cartridge houses a liquid holding member configured to hold the liquid, and has a liquid supply port with which the liquid is configured to be supplied to the outside,
the exterior member has, in addition to a first wall portion that is the wall portion, a second wall portion located at a position opposed to the liquid supply port of the liquid cartridge that is housed,
an outer wall surface of the second wall portion is constituted by one or more flat surfaces inclining with respect to a direction extending from the liquid supply port toward the wall portion, and
the housing member has, in addition to a first end portion that is the end portion, a second end portion located between the second wall portion and the liquid cartridge.

15. The liquid container according to claim 14,
wherein the atmosphere introduction hole and the liquid supply port of the liquid cartridge are formed so as to open in opposite directions,
the exterior member has a third wall portion that intersects the first wall portion and the second wall portion, and a fourth wall portion that intersects the first wall portion and the second wall portion and faces the third wall portion, and
a space surrounded by the first wall portion, the second wall portion, the third wall portion, and the fourth wall portion of the exterior member has a polygonal cross-section.

16. The liquid container according to claim 15,
wherein the space has a hexagonal cross-section.

17. The liquid container according to claim 15,
wherein the space has a trapezoidal cross-section.

18. A liquid container comprising:
a liquid cartridge that contains liquid;
a housing member that is constituted by a sheet-shaped member and houses the liquid cartridge; and
a box-shaped exterior member that houses the liquid cartridge housed in the housing member,
wherein the liquid cartridge has an atmosphere introduction hole with which an atmosphere is configured to be introduced to an inside of the liquid cartridge,
the exterior member has at least a wall portion located at a position opposed to the atmosphere introduction hole, and a protruding portion that extends so as to further projects than an outer wall surface of the wall portion in a direction extending from the atmosphere introduction hole toward the wall portion, and
the housing member has an end portion located between the wall portion and the liquid cartridge.

19. The liquid container according to claim 18,
wherein the liquid contains a dispersoid component,
the liquid cartridge houses a liquid holding member configured to hold the liquid, and has a liquid supply port that opens in a direction opposite to an opening direction of the atmosphere introduction hole,
the exterior member has, in addition to a first wall portion that is the wall portion, a second wall portion that is located at a position opposed to the liquid supply port and opposed to the first wall portion, and has, in addition to a first protruding portion that is the protruding portion, a second protruding portion extending in a direction extending from the liquid supply port toward the second wall portion, so as to further project than an outer wall surface of the second wall portion, and
the housing member has, in addition to a first end portion that is the end portion, a second end portion located between the second wall portion and the liquid cartridge.

20. A liquid container comprising:
a liquid cartridge that contains liquid, the liquid cartridge including an upper face having an atmosphere introduction hole and a bottom face having a liquid supply port; and
a housing member that is constituted by a sheet-shaped member and houses the liquid cartridge,
the housing member including a first end portion that is opposed to the upper face of the liquid cartridge and projects toward a side in an opening direction of the atmosphere introduction hole,
wherein the housing member houses the liquid cartridge so that the upper face and the bottom face are positioned vertically in the housing member.

21. The liquid container according to claim 20,
wherein the liquid contains a dispersoid component,
the liquid cartridge further includes a liquid holding member configured to hold the liquid, and
the housing member further includes a second end portion that is opposed to the bottom face of the liquid cartridge and projects toward a side in an opening direction of the liquid supply port.

22. A liquid container comprising:
a liquid cartridge that houses liquid containing a dispersoid component, and a liquid holding member configured to hold the liquid;
a housing member that is constituted by a sheet-shaped member and houses the liquid cartridge; and
a box-shaped exterior member that houses the liquid cartridge housed in the housing member,
the liquid cartridge has a liquid supply port with which the liquid is configured to be supplied to the outside,
the exterior member has at least a wall portion located at a position opposed to the liquid supply port,
the wall portion has a projecting portion that projects in a direction extending from the liquid supply port toward the wall portion, and
the housing member has an end portion located between the wall portion and the liquid cartridge.

23. A liquid container comprising:
a liquid cartridge that houses liquid containing a dispersoid component, and a liquid holding member configured to hold the liquid;
a housing member that is constituted by a sheet-shaped member and houses the liquid cartridge; and
a box-shaped exterior member that houses the liquid cartridge housed in the housing member,
wherein the liquid cartridge has a liquid supply port with which the liquid is configured to be supplied to an outside of the liquid cartridge,
the exterior member has at least a wall portion located at a position opposed to the liquid supply port;
an outer wall surface of the wall portion is constituted by one or more flat surfaces inclining with respect to a direction extending from the liquid supply port toward the wall portion, and
the housing member has an end portion located between the wall portion and the liquid cartridge.

24. A liquid container comprising:

a liquid cartridge that houses liquid containing a dispersoid component, and a liquid holding member configured to hold the liquid;

a housing member that is constituted by a sheet-shaped member and houses the liquid cartridge; and a box-shaped exterior member that houses the liquid cartridge housed in the housing member, wherein the liquid cartridge has a liquid supply port with which the liquid can be supplied to the outside, the exterior member has at least a wall portion located at a position opposed to the liquid supply port, and a protruding portion that extends so as to further project than a wall surface of the wall portion in a direction extending from the liquid supply port toward the wall portion, and the housing member has an end portion located between the wall portion and the liquid cartridge.

25. A liquid container comprising:

a liquid cartridge that houses liquid containing a dispersoid component, the liquid cartridge including an upper face having an atmosphere introduction hole and a bottom face having a liquid supply port, and a liquid holding member configured to hold the liquid; and a housing member that is constituted by a sheet-shaped member and houses the liquid cartridge, the housing member including an end portion that is opposed to the bottom face of the liquid cartridge and projects toward a side in an opening direction of the liquid supply port, wherein the housing member houses the liquid cartridge so that the upper face and the bottom face are positioned vertically in the housing member.

26. A liquid container comprising:

a liquid cartridge that contains liquid;

a housing member that is constituted by a sheet-shaped member and houses the liquid cartridge; and a box-shaped exterior member that houses the liquid cartridge housed in the housing member, wherein the liquid cartridge has a communication hole that is in communication with an inside of the liquid cartridge, the exterior member has at least a wall portion located at a position opposed to the communication hole;

the wall portion has a structure that guides the exterior member in a direction of falling down when the liquid container is about to be arranged with the wall portion as a bottom face that is oriented vertically downward, and the housing member has an end portion located between the wall portion and the liquid cartridge.

* * * * *